US010173806B2

(12) United States Patent
Reznikov

(10) Patent No.: US 10,173,806 B2
(45) **Date of Patent: *Jan. 8, 2019**

(54) FOLDABLE BASKET, METHOD OF MANUFACTURE, AND METHOD OF USE OF SAME

(71) Applicant: Alexander Reznikov, Owings Mills, MD (US)

(72) Inventor: Alexander Reznikov, Owings Mills, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/613,993

(22) Filed: Jun. 5, 2017

(65) Prior Publication Data

US 2017/0267401 A1 Sep. 21, 2017

Related U.S. Application Data

(63) Continuation of application No. 14/483,493, filed on Sep. 11, 2014, now Pat. No. 9,669,960.

(60) Provisional application No. 61/984,103, filed on Apr. 25, 2014.

(51) Int. Cl.
*B65D 6/16* (2006.01)
*B65D 6/26* (2006.01)
*A61G 5/10* (2006.01)

(52) U.S. Cl.
CPC ..... *B65D 7/24* (2013.01); *A61G 5/10* (2013.01); *B65D 7/32* (2013.01)

(58) Field of Classification Search
CPC ..... B65D 7/26; A61G 5/10; A61G 5/1094; A61G 5/1075
USPC ..... 297/155, 153, 162; 220/666
See application file for complete search history.

(56) References Cited

U.S. PATENT DOCUMENTS 5,454,581 A * 10/1995 Ringer ..... A61G 5/10 108/38
5,588,663 A 12/1996 Rundle
6,450,570 B1 9/2002 Hoekstra
7,216,929 B2 5/2007 Lang

* cited by examiner

*Primary Examiner* — King M Chu
(74) *Attorney, Agent, or Firm* — Garcia-Zamor IP Law; Ruy M. Garcia-Zamor

(57) ABSTRACT

A foldable basket, attachment mechanism and/or method of manufacturing the same.

20 Claims, 18 Drawing Sheets

FOLDABLE BASKET, METHOD OF MANUFACTURE, AND METHOD OF USE OF SAME

This application claims priority to and benefit of the following U.S. patent applications: (1) U.S. Provisional Patent Application 61/984,103, filed Apr. 25, 2014; and (2) U.S. patent application Ser. No. 14/483,493, filed Sep. 11, 2014; each of which is hereby incorporated by reference herein as if fully set forth in its entirety.

BACKGROUND

The present invention relates generally to baskets and, more specifically, to a foldable basket which may be attached to a structure as required by the user.

Conventional baskets provide a simple storage solution for easy transportation of small objects. However, baskets present themselves as bulky items when not in use and can often present a challenge during transportation when internal storage is not necessary or desired. Additionally, baskets generally lack a cover or lid with which to protect and conceal contents within the basket, as well as to act as a solid surface for further use. These problems can be further exacerbated when mobility of a user is limited such as when a user is limited to a wheelchair, when a user is in a cherry picker basket, or when working in a high altitude environment, such as window washing, in a deer stand, or hunter's hide, shooting bench, workbench, or in a helicopter, or the like.

It may be advantageous to provide a basket which could be at least one of configured to collapse into itself, mount securely to a desired structure, form a rigid shell when in an expanded configuration, move between expanded and collapsed configurations with only a predetermined amount of force required depending on application, that may allow for efficient transportation of the basket when not in use while still providing a usable and rigid container when a user so desires, and/or which makes storage of the basket during nonuse more convenient.

SUMMARY

In one aspect, one preferred embodiment of the present invention is directed to a basket. The basket is configured such that is it collapsible between a first collapsed basket configuration and a second expanded basket configuration. The basket includes a sidewall moveable between a first, expanded, sidewall configuration and a second, collapsed sidewall configuration. A base moveable between a first, lowered base configuration and a second, raised base configuration, is secured to the sidewall. A lever is also disposed on the sidewall. A linkage mechanism is located on the basket and configured such that rotation of the lever drives the base from the first, lowered base configuration to the second, raised base configuration when the sidewall is in the first, expanded, sidewall configuration. A resilient member is disposed on the basket to reduce the force required to rotate the lever and move the base from the first, lowered base configuration into the second, raised base configuration.

In a separate aspect, one embodiment of the present invention is directed to a method of manufacturing a basket. The method includes: providing a basket configured such that it is collapsible between a first collapsed basket configuration and a second expanded basket configuration. The basket includes a sidewall moveable between a first, expanded, sidewall configuration and a second, collapsed sidewall configuration. A base moveable between a first, lowered base configuration and a second, raised base configuration, is secured to the sidewall. A lever is also disposed on the sidewall. A linkage mechanism is located on the basket and configured such that rotation of the lever drives the base from the first, lowered base configuration to the second, raised base configuration when the sidewall is in the first, expanded, sidewall configuration. A resilient member is disposed on the basket to reduce the force required to rotate the lever and move the base from the first, lowered base configuration into the second, raised base configuration.

In a separate aspect, one embodiment of the present invention is directed to a basket. The basket is configured such that is it collapsible between a first collapsed basket configuration and a second expanded basket configuration. The basket includes a sidewall moveable between a first, expanded, sidewall configuration and a second, collapsed sidewall configuration. A base moveable between a first, lowered base configuration and a second, raised base configuration, is secured to the sidewall. A linkage mechanism is located on the basket and configured such that it drives the base from the first, lowered base configuration to the second, raised base configuration when the sidewall is in the first, expanded, sidewall configuration.

In another aspect, one preferred embodiment of the present invention is directed to a basket. The basket is configured such that is it collapsible between a first collapsed basket configuration and a second expanded basket configuration. The basket includes a sidewall moveable between a first, expanded, sidewall configuration and a second, collapsed sidewall configuration. A base moveable between a first, lowered base configuration and a second, raised base configuration, is secured to the sidewall. A linkage mechanism is located on the basket and configured such that the linkage mechanism can drive the base from the first, lowered base configuration to the second, raised base configuration when the sidewall is in the first, expanded, sidewall configuration. The linkage mechanism includes a weighted first linkage such that the weight of the first linkage directly drives the movement of the base from the first, lowered base configuration into the second, raised base configuration.

In one aspect, one preferred embodiment of the present invention is directed to a basket. The basket is configured such that it is collapsible between a first collapsed basket configuration and a second expanded basket configuration. The sidewall is formed by a plurality of rigid plate-like panels attached end to end and moveable between a first, expanded, sidewall configuration and a second, collapsed sidewall configuration. A base is formed by rigid plate-like panels that are moveable between a first, lowered base configuration and a second, raised base configuration, the basket being configured to reduce the force required to move the base from the first, lowered base configuration into the second, raised base configuration.

In another aspect, one preferred method of the present invention includes the following steps: providing a sidewall moveable between a first, expanded, sidewall configuration and a second, collapsed sidewall configuration, when in the first expanded, sidewall configuration the sidewall forms at least a first layer of rigid material that forms the lateral sides of the basket;

providing a base moveable between a first, lowered base configuration and a second, raised base configuration, the base securing the sidewall in the first, expanded sidewall configuration when the base is in the first, lowered base configuration; the base forming at least a second layer of rigid material when the base is in the first, lowered base configuration, interconnecting the base to the sidewall such that force applied on the collapsible basket will move the base to the second, raised base configuration and move the sidewall to the second, collapsed sidewall configuration, wherein when the sidewall is in the first, expanded sidewall configuration and the base is in the first, lowered base configuration the first layer of rigid material of the sidewall and the second layer of rigid material of the base combine to provide a rigid shell for lateral sides and the base of the collapsible basket.

In another aspect, one preferred method of the present invention includes the following steps: providing a sidewall moveable between a first, expanded, sidewall configuration and a second, collapsed sidewall configuration, when in the first expanded, sidewall configuration the sidewall forms at least a first layer of rigid material that forms the lateral sides of the basket;

providing a base moveable between a first, lowered base configuration and a second, raised base configuration, the base securing the sidewall in the first, expanded sidewall configuration when the base is in the first, lowered base configuration; the base forming at least a second layer of rigid material when the base is in the first, lowered base configuration; interconnecting the base to the sidewall and biasing the interconnection such that force applied on the collapsible basket will move the base to the second, raised base configuration and move the sidewall to the second, collapsed sidewall configuration, wherein when the sidewall is in the first, expanded sidewall configuration and the base is in the first, lowered base configuration the first layer of rigid material of the sidewall and the second layer of rigid material of the base combine to provide a rigid shell for lateral sides and the base of the collapsible basket.

In another aspect, one preferred method of the present invention includes the following steps: providing a sidewall formed of rigid, non flexible plates moveable between a first, expanded, sidewall configuration and a second, collapsed sidewall configuration, when in the first expanded, sidewall configuration the sidewall forms at least a first layer of rigid material that forms the lateral sides of the basket; providing a base formed of rigid non flexible plates moveable between a first, lowered base configuration and a second, raised base configuration, the base securing the sidewall in the first, expanded sidewall configuration when the base is in the first, lowered base configuration; the base forming at least a second layer of rigid material when the base is in the first, lowered base configuration; interconnecting the base to the sidewall and biasing the interconnection such that force applied on the collapsible basket will move the base to the second, raised base configuration and move the sidewall to the second, collapsed sidewall configuration, wherein when the sidewall is in the first, expanded sidewall configuration and the base is in the first, lowered base configuration the first layer of rigid material of the sidewall and the second layer of rigid material of the base combine to provide a rigid shell for the lateral sides and the base of the collapsible basket.

In another aspect, one preferred method of the present invention includes the following steps: providing a basket having a body made entirely of rigid non flexible plates which is moveable between expanded and collapsed configurations, biasing the basket to reduce the amount of force to move between configurations.

In another aspect, one preferred method of the present invention includes the following steps: providing a basket having a body made entirely of rigid non flexible plates which is moveable between expanded and collapsed configurations, interconnecting a sidewall and a base of the basket such that the basket is moveable between configurations.

In another aspect, one preferred method of the present invention includes the following steps: providing a basket having a body made entirely of rigid non flexible plates which is moveable between expanded and collapsed configurations, interconnecting a sidewall and a base of the basket such that the basket is moveable between configurations with a reduced amount of force without the use of electronic components or motors.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

As illustrated in FIG. 21, the linkage bars fully rotate, moving the basket parallel to the side-arm tubing of the wheel chair and away from the user; The mounting arm linkage system is shown to adapt to a wheel chair tube but any attachment method can be used to connect the collapsible basket to a desired structure;

DETAILED DESCRIPTION OF THE PREFERRED EMBODIMENTS

Figure 1:
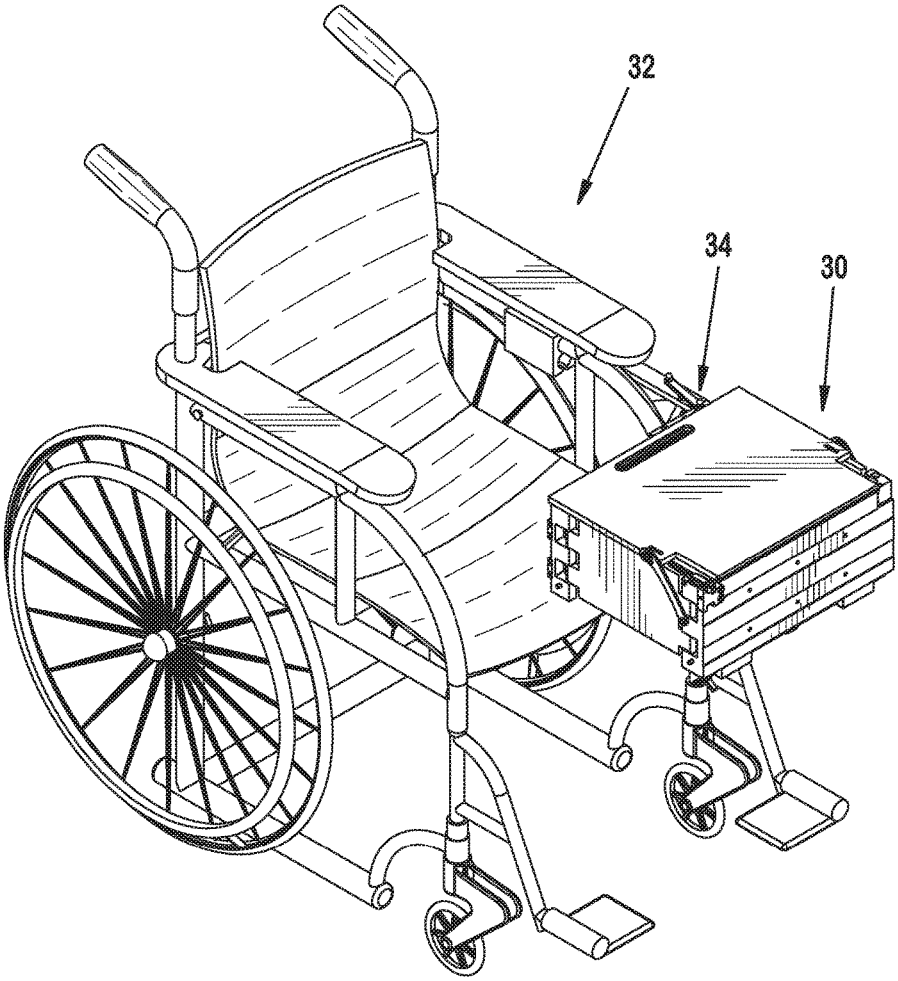
FIG. 1 is a perspective view of a foldable basket according to a preferred embodiment of the present invention used with a wheelchair; The foldable basket may include the sidewall in the first, expanded sidewall configuration, the base in the first, lowered base configuration, and the lid in the horizontal orientation, perpendicular to the sidewall; This embodiment illustrates one possible orientation of the foldable basket, wherein the basket is positioned in front of the wheelchair, and at a height above the user's knees, such that it provides an easily accessible surface for work; The basket is preferably mounted to the side arm of the wheelchair by means of a mounting linkage system which may allow the basket to freely expand for use or collapse for storage; The basket may be rectilinear in shape and of any depth desired by the user; Those of ordinary skill in the art will appreciate from this disclosure that the basket can be used with any structure, such as shelves, cherry picker baskets, boats, aircrafts, water crafts, space vehicles, powered vehicles, hang gliders, bicycles, motorcycles, as a saddle bag for bicycles or motorcycles, scaffolding, window washing equipment, construction equipment, helicopters, desks, etc., without departing from the scope of the present invention; #

Certain terminology is used in the following description for convenience only and is not limiting. The words "right", "left", "top", "bottom", designate directions in the drawings to which reference is made. The term "vertical" and "horizontal" refer to generally planar positions relative to the structure which the collapsible basket is to be attached. "Vertical" refers to a generally up and down position, while "horizontal" refers to a generally left to right position. The term "lid", as used in the claims and corresponding portions of the specification means "any lid, cover, plate, panel, or the like". The term "first, expanded sidewall configuration" refers to the sidewall panels in an expanded configuration such that the panels form a rectilinear or other shape, thereby defining the outward perimeter of the basket. The term "second, collapsed sidewall configuration" refers to the sidewall panels in a generally collapsed configuration such that the panels align in a similar planar orientation, thereby reducing the overall perimeter of the basket. The term "first, lowered base configuration" refers to the base flaps configured such that they are interlocked and provide a bottom portion for the basket. The term "second, raised base configuration" refers to the base flaps aligned in a generally similar planar orientation such that all flaps reside closely adjacent to each other and to the sidewall panels. The term "raised first linkage position" refers to the first linkage in a generally raised position such that it is not in contact nor driving the first rocker arm pedal. The term "lowered first linkage position" refers to the first linkage in a lowered position such that it is engaging and driving the first rocker arm pedal. The terms "second linkage position" and "another second linkage position" refer to alternate positions of the second linkage whereby the second linkage is either not driving the second rocker arm pedal or driving it upward toward the base flaps, respectively. The term "linkage" refers to any means of translating force and positioning between two members of the basket 30. The terms "proximate" and "adjacent" are used interchangeably and are meant to refer to a similar distance of no more than about six (6) inches. Additionally, the words "a" and "one" are defined as including one or more of the referenced items unless specifically stated otherwise. The terminology includes the words above specifically mentioned, derivatives thereof, and words of similar import.

Referring to FIGS. 1-28, wherein like numerals indicate like elements throughout, preferred embodiments of a collapsible basket according to the present invention are shown and generally designated as 30. Briefly speaking the collapsible basket 30 can be fixed to a structure, such as a wheelchair 32, and may be moveable between a first collapsed basket configuration and a second expanded basket configuration to provide a transportable compartment when necessary and efficient stowage when not in use. Additionally, neoprene or other softer materials can be used for the lid or other components if desired. Similarly, electronics can be integrated into the basket, such as a tablet, speakers, laptop, etc. without departing from the scope of the present invention. Alternatively, the lid can be configured to serve as a cutting board, art easel, or to serve any other function without departing from the scope of the present invention. For example a hole or flap can be placed in the lid to allow one who is cutting on the lid to be able to drop scraps or choice selections into the basket such that the desired portions can be collected in the basket. Similar sorting operations can be integrated into the lid without departing from the scope of the present invention, such as integrating a coin sorter or the like.

The collapsible basket 30 is preferably formed by a sturdy, corrosion-resistant material such as stainless steel. However, any suitable material can be used without departing from the scope of the present invention. For example, the collapsible basket 30 may be formed of wood or a hardened plastic composite without departing from the scope of the invention.

It is preferred, but not necessary, that the basket does not have any motorized components nor any electrical components for moving the basket 30 between a first collapsed basket configuration 82 (described below) and a second expanded basket configuration 84 (described below) such that movement therebetween is accomplished by at least one of a mechanical linkage and the resilient member.

Figure 2:
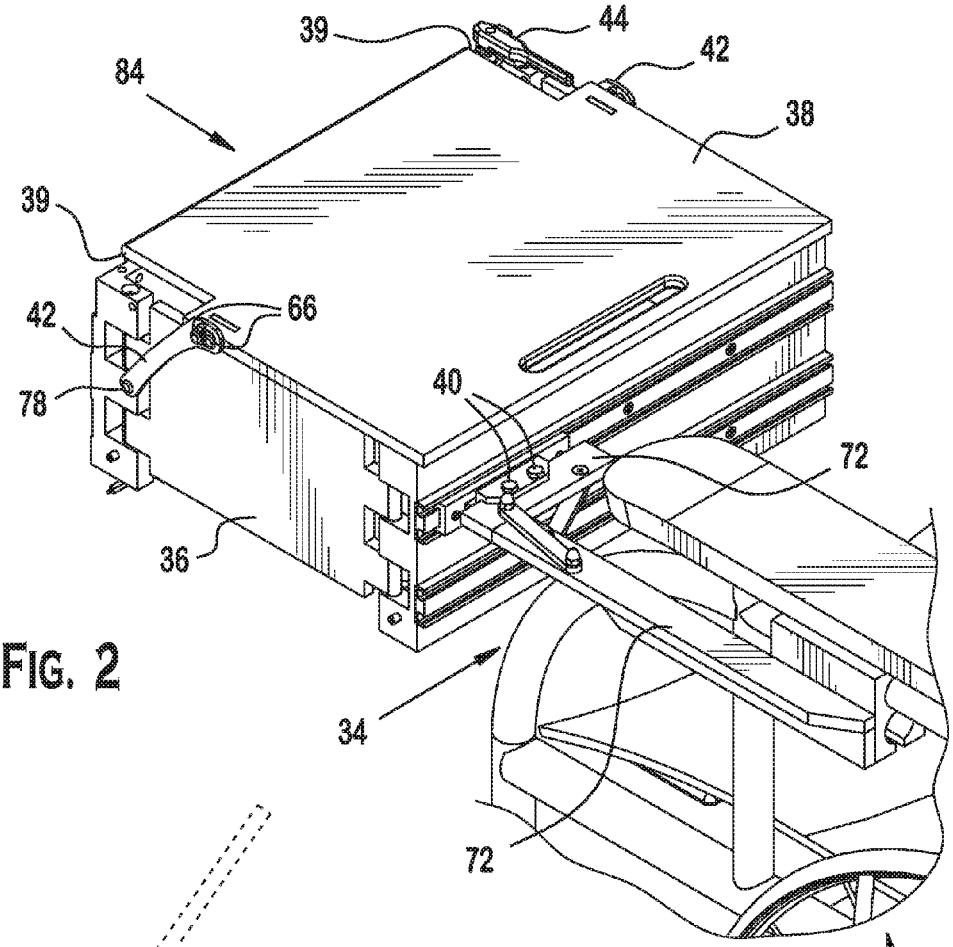
FIG. 2 is another perspective view of the foldable basket of FIG. 1 illustrating a preferred mounting linkage system for use with an object such as a wheelchair; The mounting linkage system is shown attaching the collapsible basket to the wheelchair but the mounting linkage system can be used and attached to a number of structures as determined by the user; The structures can be boats, bicycles, airplanes, trucks, moving trucks, work trucks, tool boxes, utility trucks, moving trucks, bicycles, on a treadmill or other exercise equipment, motorcycles, grocery store check outs, or used in any place or attached to any type of structure or vehicle in which having a foldable basket is desired; The mounting linkage system may orient the basket such that it is placed above the user's legs, providing an easily accessible surface to access; Additionally, the collapsible basket is shown with the sidewalls in the first, expanded sidewall configuration, the base is in the first, lowered base configuration, and the lid is in the horizontal orientation but the collapsible basket can be stowed away such that the sidewall is in the second, collapsed sidewall configuration, the base is in the second, raised base configuration, and the lid is in the vertical orientation; The lid may have a recess positioned toward the user to provide leverage to drive the lid from the horizontal position to the vertical position; The lid may also completely conceal the interior of the basket so as to conceal the contents inside the basket, or optionally only provide partial coverage.

Referring to FIG. 2, a first preferred method of manufacturing a collapsible basket 30 according to the present invention is as follows. A mounting linkage system 34 affixes the collapsible basket to a structure 32. The mounting linkage is attached to a sidewall 36 preferably, but not necessarily, by a series of bolts 40.

Figure 5:
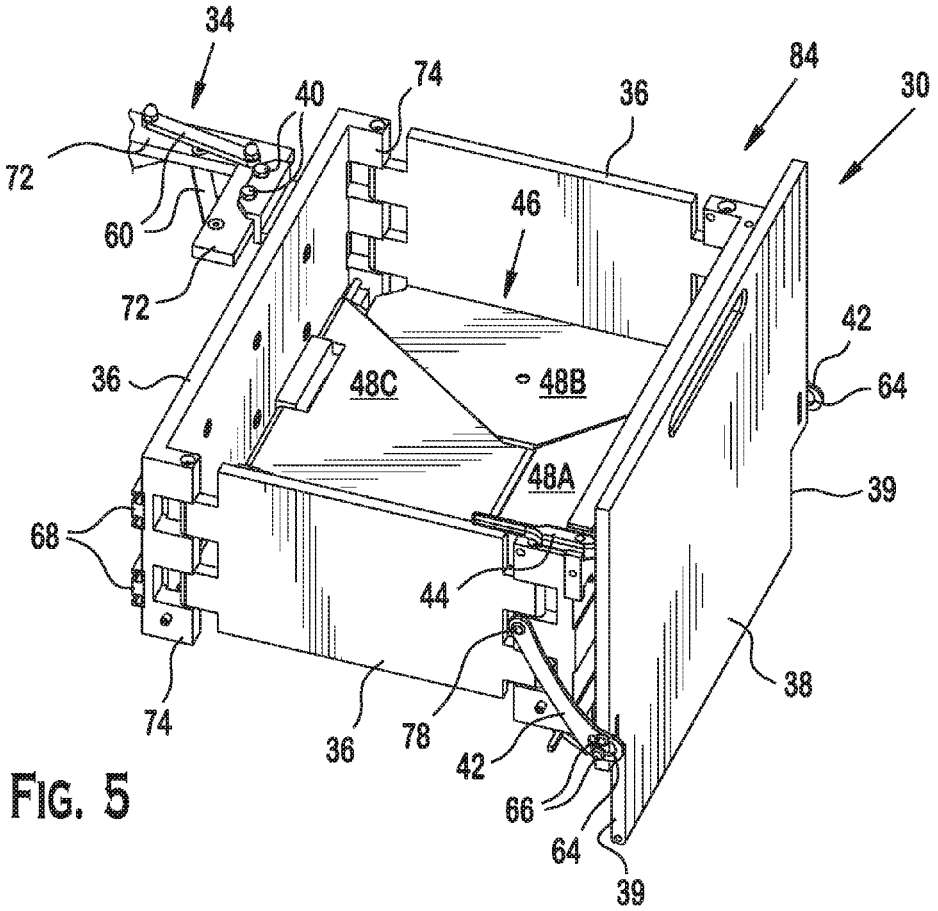
FIG. 5 is perspective view of the collapsible basket of FIG. 1 illustrating the interior of the collapsible basket when the lid is in the vertical orientation; The sidewall is shown in the first, expanded sidewall configuration and the base is shown in the first, lowered base configuration; The base may be comprised of individual flaps which are hinged to the bottom of each sidewall; The flaps may be of a generally trapezoidal shape and designed to interfere with one another at the first, lowered base configuration so as to form a rigid surface which can support contents inside the basket, however, flaps of any shape and size can be used without departing from the scope of the invention; The sidewall may be comprised of individual panels which are hinged side-to-side to preferably form a rectilinear shape, but any shape may be used without departing from the scope of the present invention.
Figure 20:
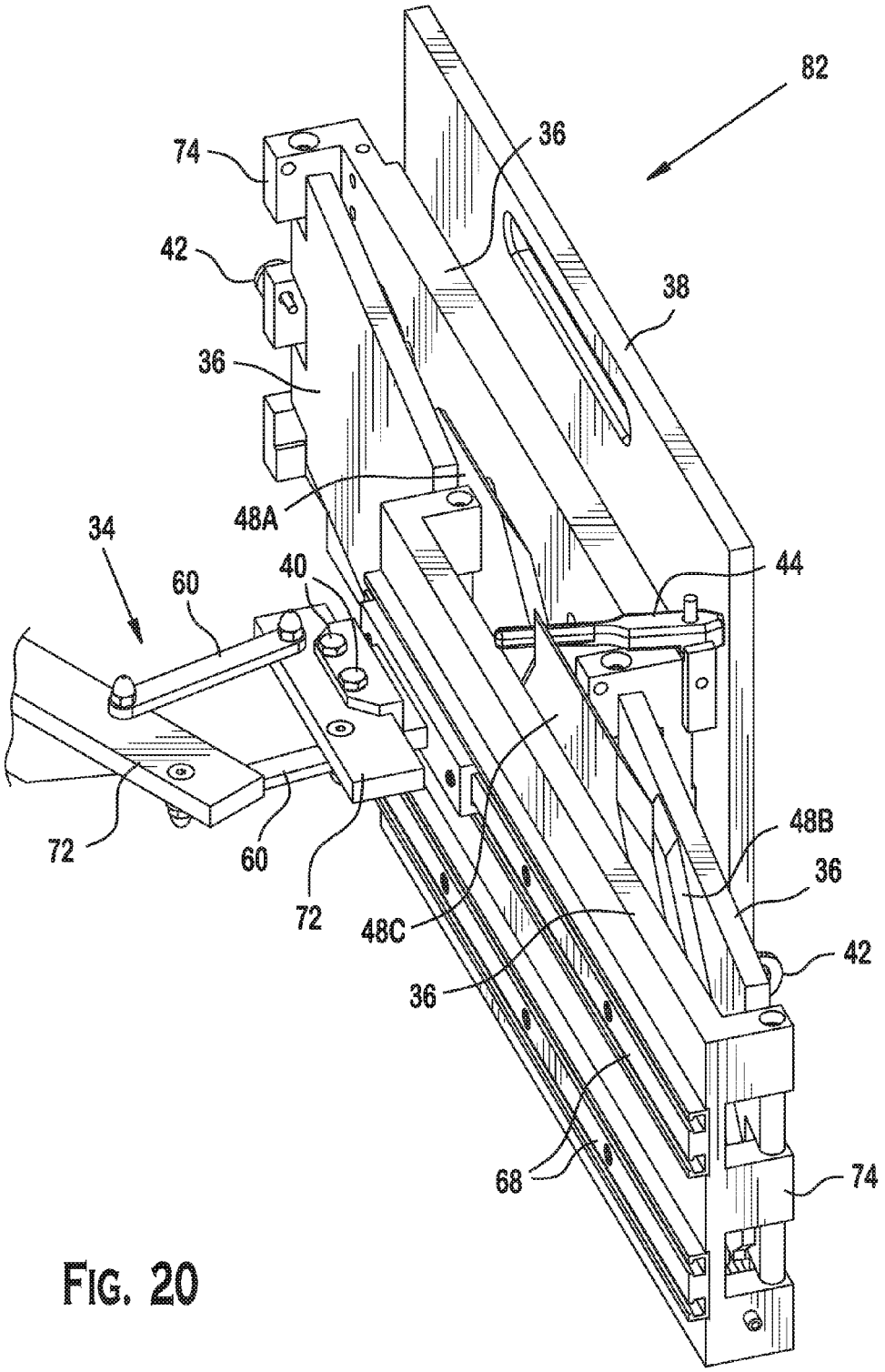
FIG. 20 is a perspective view of the collapsible basket of FIG. 17, illustrating the mounting arm linkage system rotating from an extended orientation to a stowed orientation; The linkage bars generally can rotate so as to move the collapsed basket about the structure; The mounting linkage system is preferably attached to one of the plurality of panels to moveably attach the basket to an object such that the basket can move between a first collapsed basket configuration for storage adjacent the object and a second expanded basket configuration; Those of ordinary skill in the art will appreciate from this disclosure that the mounting arm linkage can be attached to any portion of the basket without departing from the scope of the present invention.

The sidewall 36 is moveable between a first, expanded sidewall configuration (illustrated in FIG. 5) and a second, collapsed sidewall configuration (illustrated in FIG. 20). The sidewall 36 may also comprise a plurality of panels, attached end-to-end to form a rectilinear shape, although any shape may be used without departing from the scope of the invention. Also, any number of panels may be used to form any desired shape of the sidewall 36. A lid 38 is preferably attached to the sidewall 36 by a lid mounting hinge 42 and lid mounting pin 78. The lid 38 may rotate about the lid mounting pin 78. The lid 38 is moveable between a horizontal orientation (as shown in FIG. 2) and a vertical orientation (as shown in FIG. 5). The lid can additionally be of any material, comprise any coating, and generally include any device, such as a tablet without departing from the scope of the lid in the invention. Additionally, the lid 38 may be omitted entirely, providing a basket 30 without a cover, without departing from the scope of the invention. A lever 44 is preferably disposed on the sidewall 36, specifically on the perpendicular extension 74, but the lever may be placed anywhere along or above the sidewall. Those of ordinary skill in the art will appreciate from this disclosure that the lever may be omitted entirely without departing from the scope of the present invention.

Figure 3:
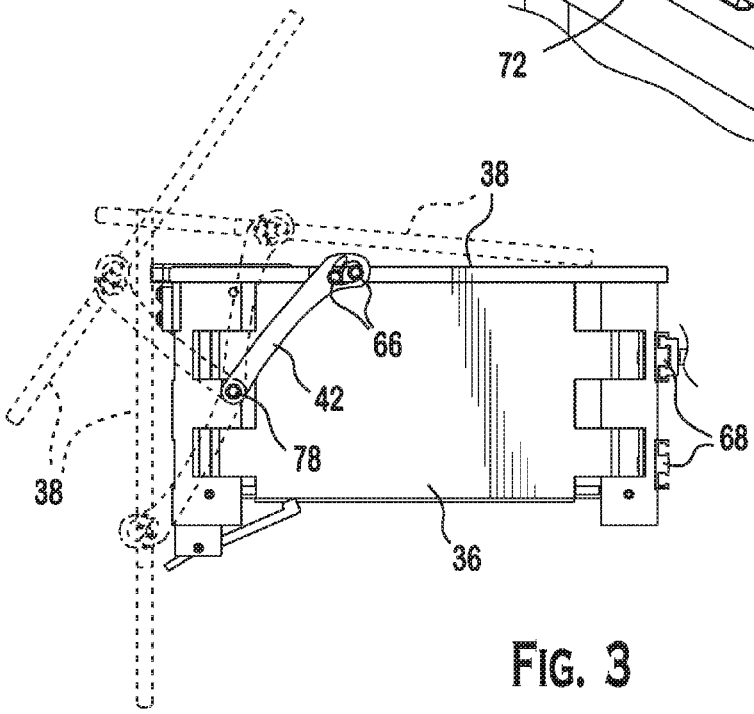
FIG. 3 is a left side elevation view of the collapsible basket of FIG. 1 illustrating the ability of the lid to move from a generally horizontal orientation, perpendicular to the sidewall (shown in solid lines), to a generally vertical orientation, parallel with the sidewall (shown in dashed lines); However, the lid may move from any orientation relative to the sidewall without departing from the scope of the invention; The lid can be made of any material suitable for a working surface such as stainless steel, wood, or hard-plastic and may also comprise a rubber covering; The lid can also comprise a different structure, such as a tablet or similar device to incorporate into the basket without departing from the scope of the invention; A lid mounting hinge may be secured along the sidewall and fixed to the lid such that rotation occurs about an axis along the sidewall; Additionally, the lid can rotate independent of the configuration of the sidewall or base; The lid mounting hinge can be connected in any manner to preferably allow the lid to completely cover the basket in the horizontal position; The lid mounting hinge can also contain two cams at the securement point with the lid to allow the lid to efficiently rotate with the lid mounting hinge from the horizontal orientation to the vertical orientation; Those of ordinary skill in the art will appreciate from this disclosure that the lid may not cover the entire basket well and/or may be inclined as desired without departing from the scope of the present invention.

Referring to FIG. 3, the lid 38 can be seen moving between a horizontal orientation (as demonstrated in solid lines) and a vertical orientation (as demonstrated in dashed lines). It is preferred that the lid 38 rotates in connection with the lid mounting hinge 42 along an affixed point of the sidewall 36 at the lid mounting pin 78. The lid 38 can move between any orientation, however, without departing from the scope of the invention. For example, the lid can rest above the sidewall in an inclined orientation so as to angle toward the user or likewise stow obliquely depending upon the structure 32 thereby attached. Referring to the upper portion of FIG. 2, the upper right side of the lid 38 preferably has a cutout 39 therein which is preferably at least partially coplanar with the lever 44. It is preferred, but not necessary, that when the lid 38 is in the closed position (as shown in FIG. 2) that the lever 44 is nested in the cutout 39 such that the lever 44 cannot be rotated sufficiently to disengage the basket from the expanded configuration. This may be used as a mechanism to reduce the probability of accidental closure of the basket. As also shown in FIG. 2, the cutout 39 can be placed elsewhere and a second cutout 39 is shown on the upper left portion of the lid 38. As mentioned herein the lever 44 can be placed in any position on the basket and accordingly the position of the cutout 39 can be moved to accommodate the actual position of the lever 44. Those of ordinary skill in the art will appreciate from this disclosure that any other suitable mechanism for preventing the basket from moving from the expanded configuration when the lid is closed can be used without departing from the scope of the present invention.

Figure 4:
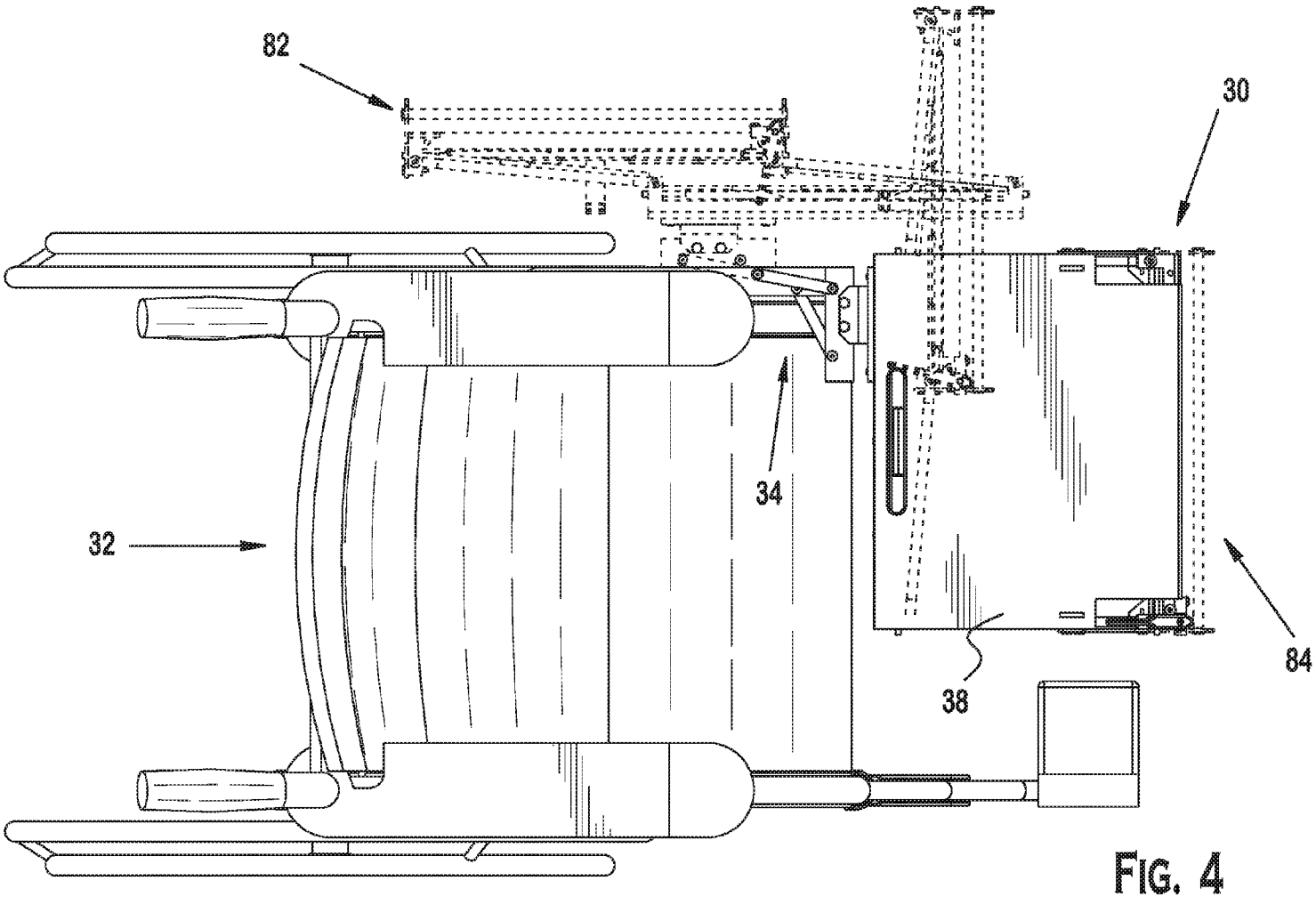
FIG. 4 is a top plan view of the collapsible basket of FIG. 1 illustrating the ability of the basket and associated components to move between their full ranges of motion relative to an object such as a wheelchair; The foldable basket can be moveable between its first collapsed basket configuration and its second expanded basket configuration, the lid moveable between its horizontal and vertical orientation, and the mounting arm linkage rotatable about an axis; The basket is shown in its expanded orientation in solid lines and its collapsed and stowed orientation in dashed lines; The basket is preferably stowed proximate the side of the wheelchair but any stowage location can be used depending upon the user and the structure attached with the basket; Alternatively, the basket may be oriented in a retraced basket position proximate the wheelchair while remaining in its second expanded basket configuration; For example, the mounting linkage system could be designed to stow the collapsed basket underneath the wheelchair seat without departing from the scope of the present invention.

Referring to FIG. 4, the basket 30 is preferably rotatable between an extended, outward position (also referred to as "an extended basket position") and a stowed, collapsed position (also referred to as "a retracted basket position"). The mounting linkage system 34 generally rotates the basket 30 from the extended, outward position to the stowed, collapsed position. The mounting linkage system preferably places the basket 30 closely adjacent to the structure 32 for more efficient transport, away from the user. The box is generally rectilinear when in the extended, outward position (as seen in solid lines) and generally planar when in the stowed, collapsed position parallel to the wheelchair 32 (as seen in dashed lines). The outward position and the stowed planar positions may be of any orientation separate from the preferred embodiments shown in the figures. It is preferred that the basket should cover the entire front width of the wheelchair when in the expanded configuration. However, those of ordinary skill in the art will appreciate from this disclosure that any sized basket can be used with any object without departing from the scope of the present invention. In the event that the basket does extend the entire width of the front of the wheelchair or other structure it may be desirable to have a second interconnection on the opposing armrest so that there are two points of support between the basket and the wheelchair.

Figure 6:
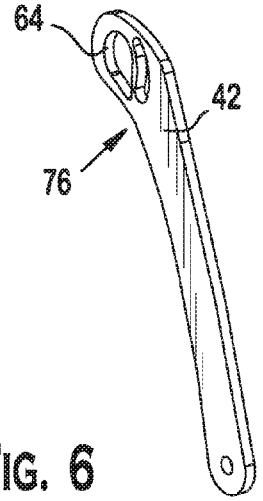
FIG. 6 is a perspective view of the lid mounting hinge of FIG. 3, which attaches the lid to the sidewall of the collapsible basket; The lid mounting hinge may have cam journals positioned at one end to facilitate rotation of the lid from the horizontal orientation to the vertical orientation; The lid mounting hinge is preferably an elongated shape, with a large radius bend on the cam journal end; One cam journal is preferably tear-drop shaped while the other, positioned closely adjacent thereto, is crescent shaped; Any number and shape of cam journals may be used however.
Figure 7:
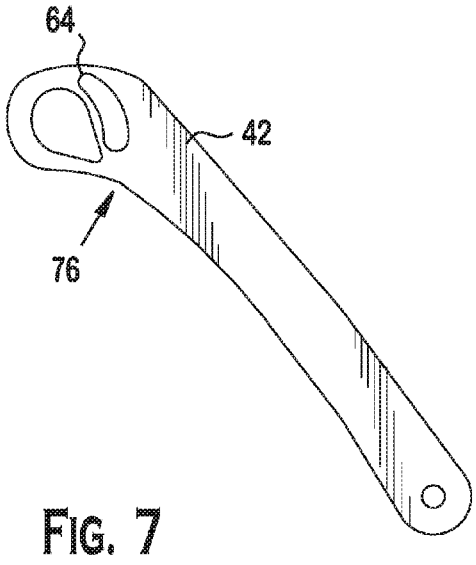
FIG. 7 is a side view of the lid mounting hinge of FIG. 6; The lid mounting hinge is preferably linear with a large-radius bend at one end to connect to the lid; A pin hole located at the opposite end of the lid mounting hinge from the cam journals, preferably cylindrical in shape, provides a mounting point against the sidewall.

Referring to FIGS. 5-7, a basket of the present invention may include a base 46. The base 46 is moveable between a first, lowered base configuration and a second, raised base configuration, the base 46 securing the sidewall 36 in the first, expanded sidewall configuration when the base 46 is in the first, lowered base configuration. The base 46 may include a plurality of flaps 48A, 48B, 48C, 48D, each flap preferably attached independently to a panel of the sidewall 36. The flaps 48A, 48B, 48C, 48D are shown in the preferred embodiment with a generally trapezoidal shape but any shape may be used. When in the first lowered based configuration, the preferably trapezoidal flaps 48A, 48B, 48C, 48D interlock between each other such as to create a rigid base 46 of the basket 30. When in the second raised base configuration, the preferably trapezoidal flaps raise toward a vertical planar position inside the basket 30. The sidewall 36 preferably also comprises a pair of opposing face panels of the plurality of panels which each include a plurality of perpendicular extensions 74 thereon. The perpendicular extensions 74 may provide proper orientation of the sidewall 36 configuration. A lid mounting hinge 42 is preferably fixed to the sidewall 36 such that the lid 38 can be rotated between a vertical orientation and a horizontal orientation. FIGS. 6 and 7 illustrate the lid mounting hinge 42, preferably including orifices whereby the lid mounting hinge can attach and rotate the lid 38 about the sidewall 36, whereby the lid mounting pin 78 may attach. The orifices of the lid mounting hinge 42 may generally form cam journals 64 whereby pins 66 may follow the prescribed path to efficiently rotate the lid 38 about the basket 30. it is preferably, but not necessary, that the flaps 48A, 48B, 48C, 48D are gravity driven when the basket is being moved into the expanded configuration.

Figure 8:
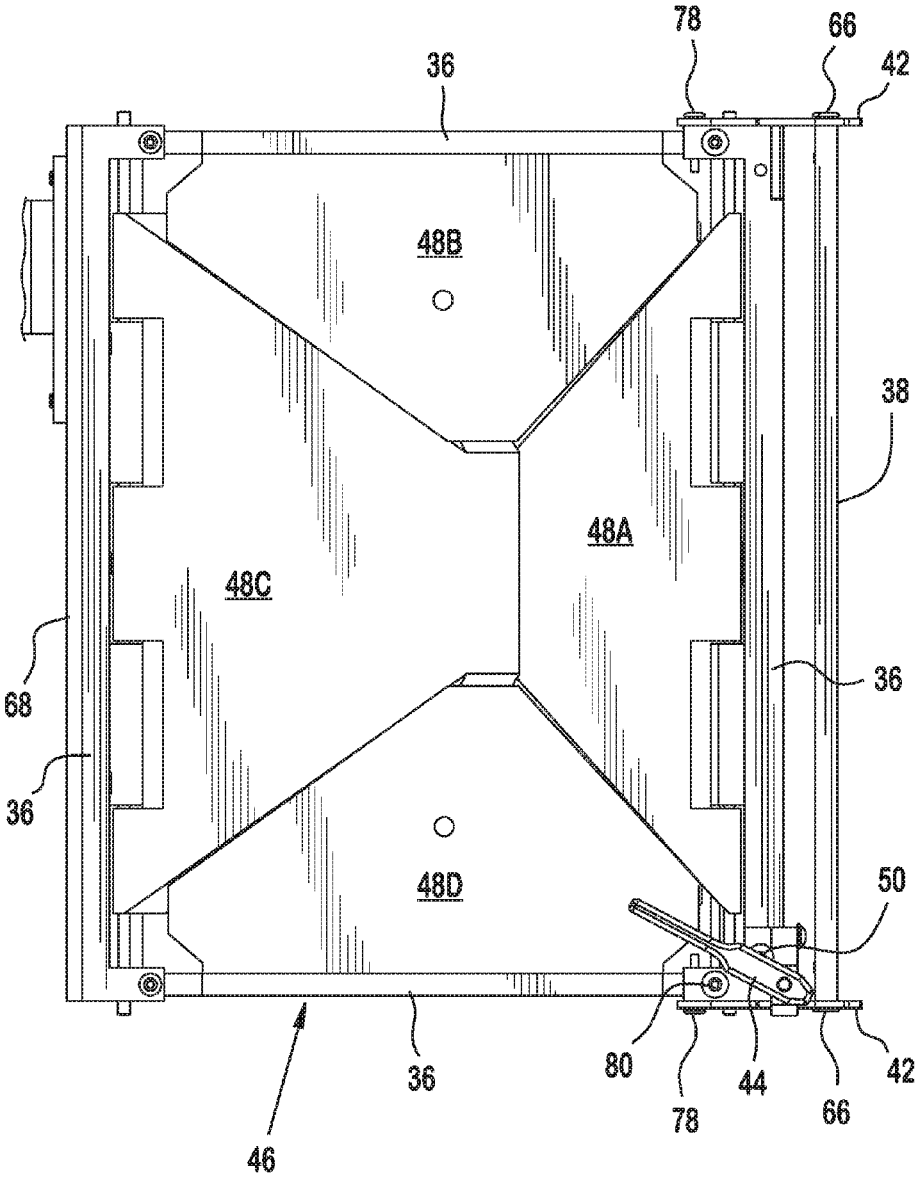
FIG. 8 is a top plan view of the collapsible basket of FIG. 1; The base is shown just beginning to move from the first, lowered base configuration to the second, raised base configuration; The base flaps may be trapezoidal in shape, locking together at the central interface to create a rigid base when any downward pressure is applied; The lever disposed on the sidewall is rotated such that it interferes with the linkage mechanism to drive the base from the first, lowered base configuration to the second, raised base configuration; The lever is preferably, but not necessarily, a long, linear shape to allow a user to hold and rotate the lever about the fixed end; The fixed end may be connected to the sidewall via a bolt, bearing, or other means to allow free rotation; Alternatively, the lever may be omitted without departing from the scope of the invention; For example, the linkage mechanism may function without a lever, whereby a force is directed directly to the linkage mechanism, thereby driving the basket from one orientation to another; While a preferred lid connection system is shown those of ordinary skill in the art will appreciate from this disclosure that any suitable connection means can be used without departing from the scope of the present invention; Similarly, the lid can be omitted entirely without departing from the scope of the present invention; For example a push button can be used in place of the lever and detent to drive the first linkage without departing from the scope of the present invention; Additionally, the mechanical linkage can be supplemented or replaced with electrical motors and/or other components to facilitate operation of the basket and related parts without departing from the scope of the present invention.

Referring to FIG. 8, the basket of the present invention may include a lever 44 and linkage mechanism comprising a first linkage 50 which is preferably positioned parallel with the sidewall 36. In a preferred embodiment, the lever 44 is rotatable about a vertical axis such that it is able to interfere and drive the first linkage downward. The first linkage 50 is preferably configured such that rotation of the lever 44 drives the base from the first, lowered base configuration to the second, raised base configuration when the sidewall is in the first, expanded sidewall configuration. The base 46 may generally include flaps 48A, 48B, 48C, 48D which may be trapezoidal, and interlock together in the first, lowed based configuration so as to create a rigid base to store items inside the basket. The flaps can alternatively be any shape without departing from the scope of the invention.

Figure 9:
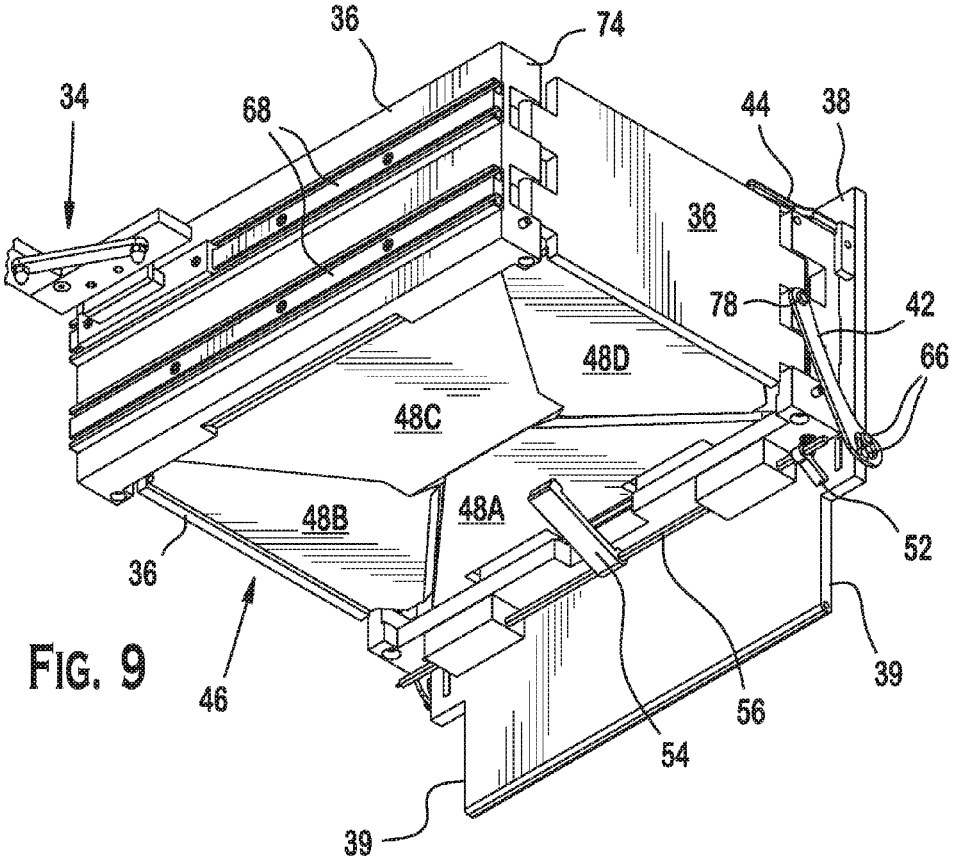
FIG. 9 is a perspective bottom view of the collapsible basket of FIG. 1 illustrating the base moving from the first, lowered base configuration to the second, raised base configuration; As the lever is rotated, the linkage mechanism comprising a first linkage is driven downward to contact the first rocker arm pedal; A second linkage rotates in phase with the first rocker arm pedal, whereby a second rocker pedal also rotates and begins to drive the flaps of the base toward the second, raised base configuration; The flaps of the base are preferably trapezoidal in shape but any shape may be used.
Figure 10:
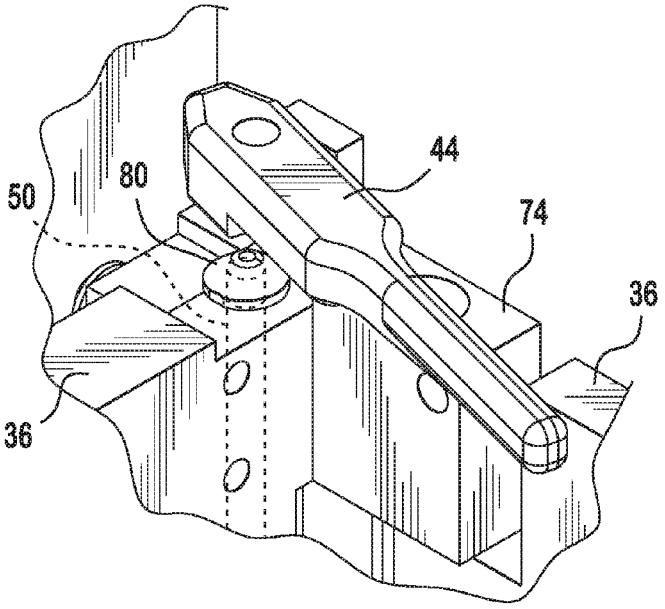
FIG. 10 is a perspective view of the lever disposed on the sidewall; The lever is shown interfering with the first linkage, thereby driving the first linkage vertically downward to initiate movement of the base from the first, lowered base configuration to the second, raised base configuration as described above in reference to FIG. 9; The lever is preferably a linear shape to allow for efficient user interaction, while the base of the lever may be designed to efficiently interact and drive the first linkage downward when rotated; Those of ordinary skill in the art will appreciate from this disclosure that the lever may be omitted without departing from the scope of the present invention.

Referring to FIGS. 9 and 10, the lever 44 preferably rotates and contacts the first linkage 50, whereby the first linkage 50 is engaged between a raised first linkage position and a lowered first linkage position. The lever 44 is preferably mounted adjacent to one of the perpendicular extensions 74 of the sidewall 36. The head 80 of the first linkage 50 is preferably rounded such that the lever 44 can efficiently contact and drive the first linkage down, as seen in FIG. 10. The first linkage 50 is preferably, but not necessarily, a rod. The first linkage 50 can alternatively comprise a plate, cam system, gears, pulley system, or the like whereby the userinduced force may be translated to the first rocker arm pedal 52. A first rocker arm pedal 52 is preferably mounted below the first linkage 50 such that downward motion of the first linkage drives the first rocker arm pedal 52 to rotate. The first rocker arm pedal 52 may be rigidly fixed to a second linkage 56, such that rotation of the first rocker arm pedal 52 drives rotation of the second linkage 56. The second linkage 56 is preferably, but not necessarily, a rod. The second linkage 56 may alternatively comprise a plate, cam system, gears, pulley system or the like whereby rotation of the first rocker arm pedal 52 is translated to rotation of the second rocker arm pedal 54. A second rocker arm pedal 54 is also rigidly fixed to the second linkage 56, so that rotation of the first rocker arm pedal 52 also rotates the second rocker arm pedal 54. The second rocker arm pedal 54 may extend toward a flap 48A of the base 46, so that rotation of the second rocker arm pedal 54 may drive the flap 48A upward.

Referring still to FIG. 9, it is preferable that the left and right flaps 48B, 48D are mirror images of each other and that the front flap 48A is somewhat bigger than the rear flap 48C to facilitate interlocking. The preferably larger front flap 48A will preferably collapse first when moving the basket into the expanded position followed by left and right flaps 48B, 48D and then followed by the rear flap 48C which would be closer to a user in the wheelchair (or other object). This is preferably achieved due to the way the basket moves into the collapsed position. Specifically, it is preferred that when moving the basket into the collapsed position, the second rocker arm pedal 54 drives the front flap 48A upwards, which then drives the left and right flaps 48B, 48D upwardly, and which then drives the rear flap 48C upwardly.

The structure mount 34 may be mounted to the sidewall 36 via adjustment tracks 68. The adjustment tracks 68 provide structure mount placement moveable along the length of the sidewall 36. Multiple adjustment tracks 68 may be provided parallel and adjacent to each other to provide multiple heights for attaching the mounting linkage system 34. The adjustment tracks 68 alternatively may also provide additional orientations of the basket 30 relative to the structure 32 without departing from the scope of the invention. For example, the adjustment tracks 68 may provide vertical adjustment as well as horizontal adjustment along the sidewall 36 of the basket 30, alternatively providing two or more multiple orientations.

Figure 11:
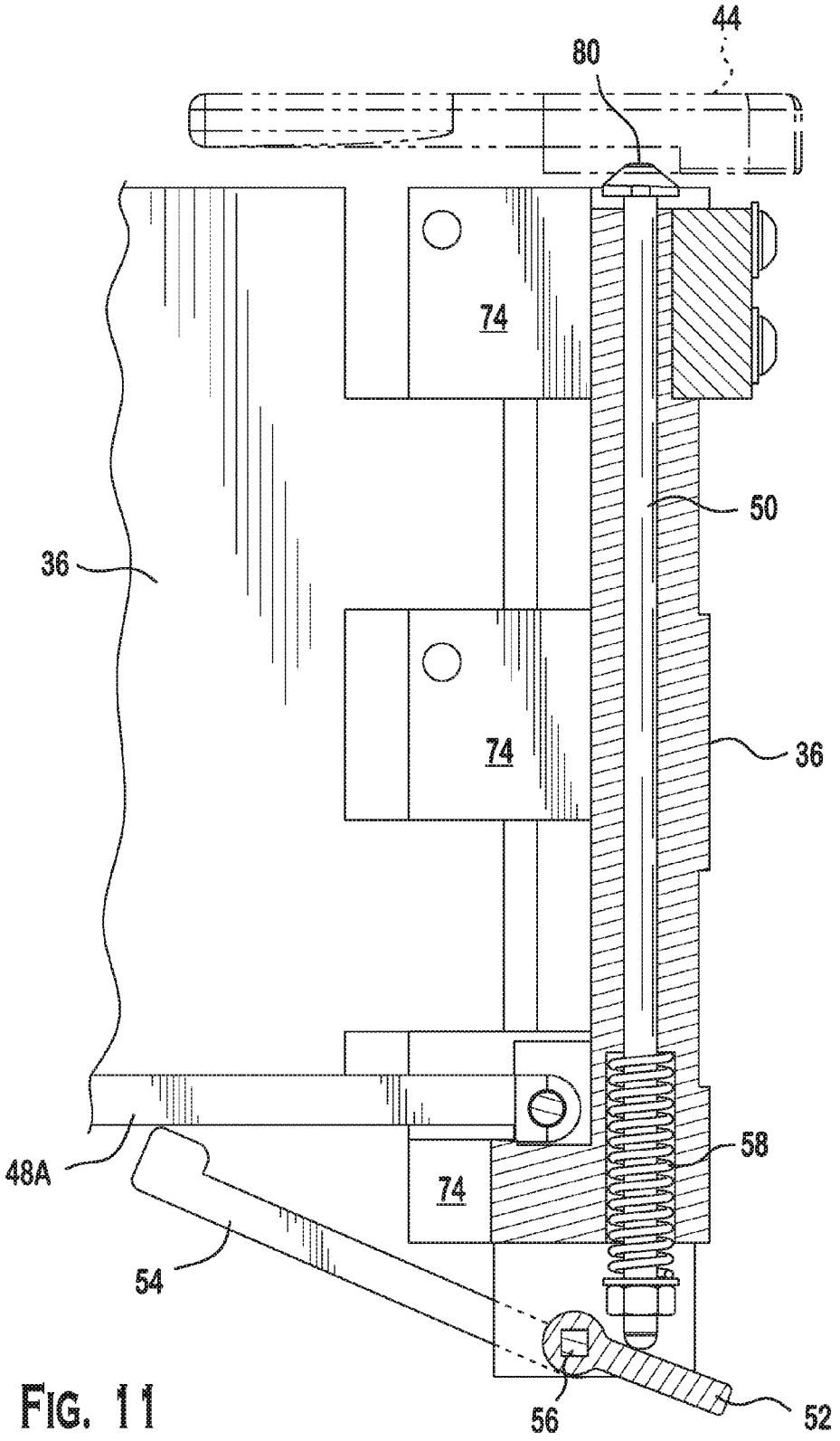
FIG. 11 is a cross-sectional view of the sidewall, lever, first linkage, and resilient member; The first linkage is shown as axially in-line with the resilient member, thereby providing a resilient force when the lever interferes and drives the first linkage downward; Alternatively, a weighted first linkage may be used in place of a resilient member to provide a similar force to engage the first rocker arm pedal; Preferably, a force or torque of between zero point zero five (0.05) pounds and zero point one five (0.15) pounds is all that is required to move the lever, with the use of a resilient member or weighted first linkage; A force or torque outside of the above range may be used without departing from the scope of the invention; Additionally, the base is shown in the first, lowered base configuration when the lever is not rotated to interfere with the first linkage; The lever (shown in dashed lines) is situated adjacent to the first linkage, whereby the first linkage remains in a raised first linkage position; With the first linkage in the raised first linkage position, the first rocker arm pedal remains stationary such that the second rocker pedal does not drive the flaps of the base upward to the second, raised base configuration; The resilient member, or likewise resilient force, may be placed at multiple different, but equally effective, locations on the basket.
Figure 12:
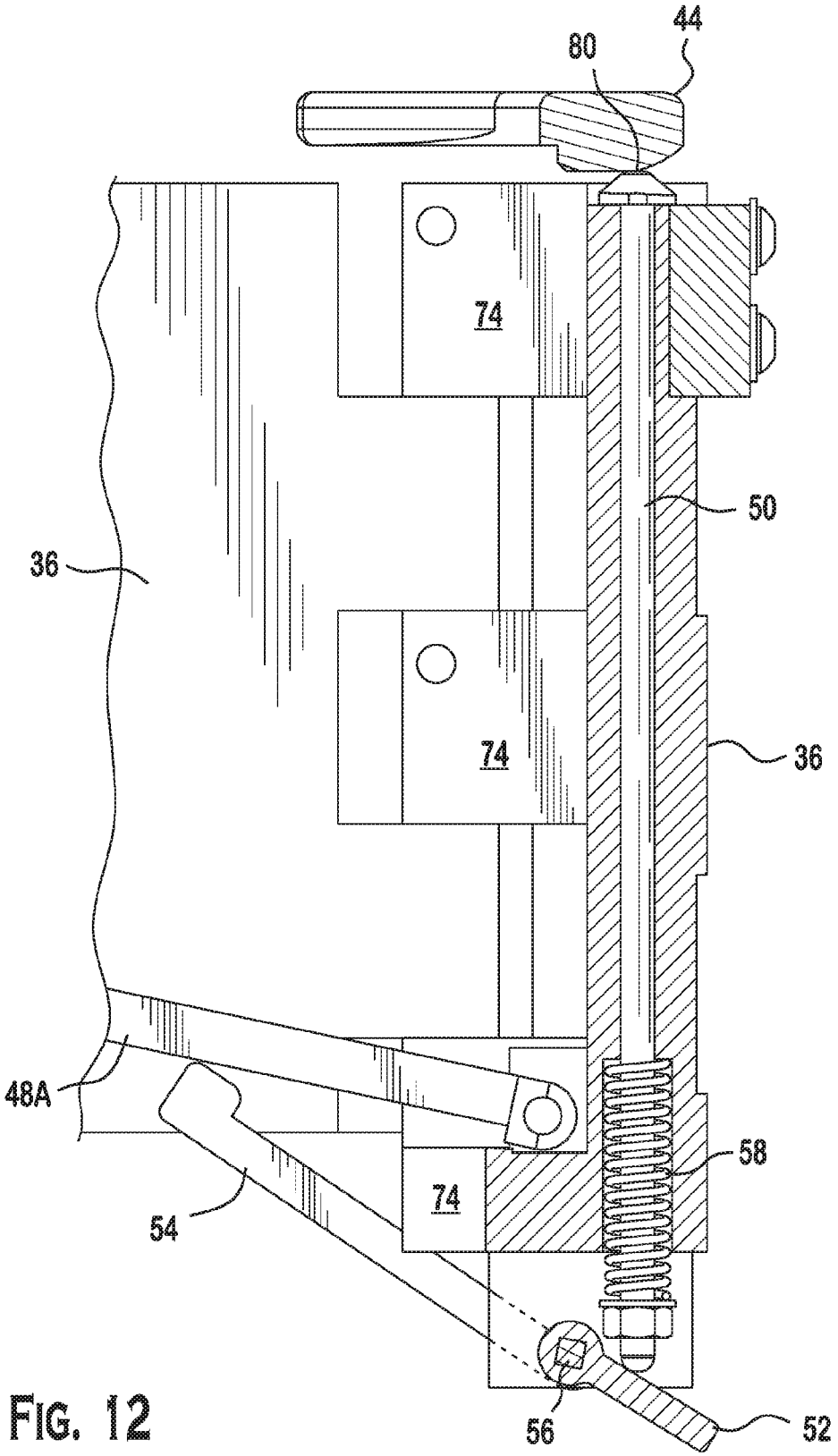
FIG. 12 is a cross-sectional view of the sidewall, lever, first linkage, and resilient member of FIG. 11; The lever (shown is solid lines) is rotated so that it interferes with the first linkage, thereby providing a downward force on a rocking arm pedal which drives the base from the first, lowered base configuration to the second, raised base configuration; The first linkage may have a rounded head to facilitate interference with the lever; As the lever pushes down on the first linkage, the first rocker arm pedal is preferably rotated whereby the second linkage and second rocker arm pedal are also rotated; The second rocker arm pedal preferably contacts a flap of the base, driving all flaps upward to the second, raised base configuration.

Referring to FIGS. 11 and 12, the lever 44 may contact the head of the first linkage 50, preferably driving the first linkage 50 and resilient member 58 downward and contacting the first rocker arm pedal 52. The resilient member 58 reduces the force required to rotate the lever and move the base from the first, lowered base configuration into the second, raised base configuration. It is preferred that the resilient member is configured such that a general force of between zero point zero one (0.01) pounds and ten (10) pounds is all that is required to move the lever and drive the basket between a second expanded basket configuration and a first collapsed basket configuration. It is more preferred that the resilient member is configured such that a general force of between zero point zero one (0.01) pounds and two (2) pounds is all that is required to move the lever and drive the basket between a second expanded basket configuration and a first collapsed basket configuration. It is more preferred still that the resilient member is configured such that a general force of between zero point zero five (0.05) pounds and zero point one five (0.15) pounds is all that is required to move the lever and drive the basket between a second expanded basket configuration and a first collapsed basket configuration. It is yet more preferred that the resilient member is configured such that a general force of about one tenth of a pound (0.1) is all that is required to move the lever and drive the basket between a second expanded basket configuration and a first collapsed basket configuration. Those of ordinary skill in the art will appreciate from this disclosure that the basket can be configured such that any predetermined amount force can be required to move the basket between the expanded and collapsed positions.

Alternatively, a weighted linkage mechanism comprising a weighted first linkage 50 may be used in place of the resilient member 58 to provide a similar applied force to the first rocker arm pedal 52. The resilient member is shown in the preferred embodiments as a coil spring but any resilient member may be used. For example, a torsion spring may be used along the second linkage 56 to provide a resilient force similar to a coil spring. Referring to FIG. 12, the lever 44 may engage the first linkage 50 head, thereby rotating the first rocker arm pedal 52 and driving a flap 48A, 48B, 48C, 48D upward toward the second, raised base configuration. The resilient member may be located anywhere on the basket 30 so as to provide a force on the first rocker arm pedal 52. For example, the resilient member 58 may be positioned on any sidewall panel 36 or flaps 48A, 48B, 48C, 48D of the base 46, or any combination therein, without departing from the scope of the invention.

Figure 13:
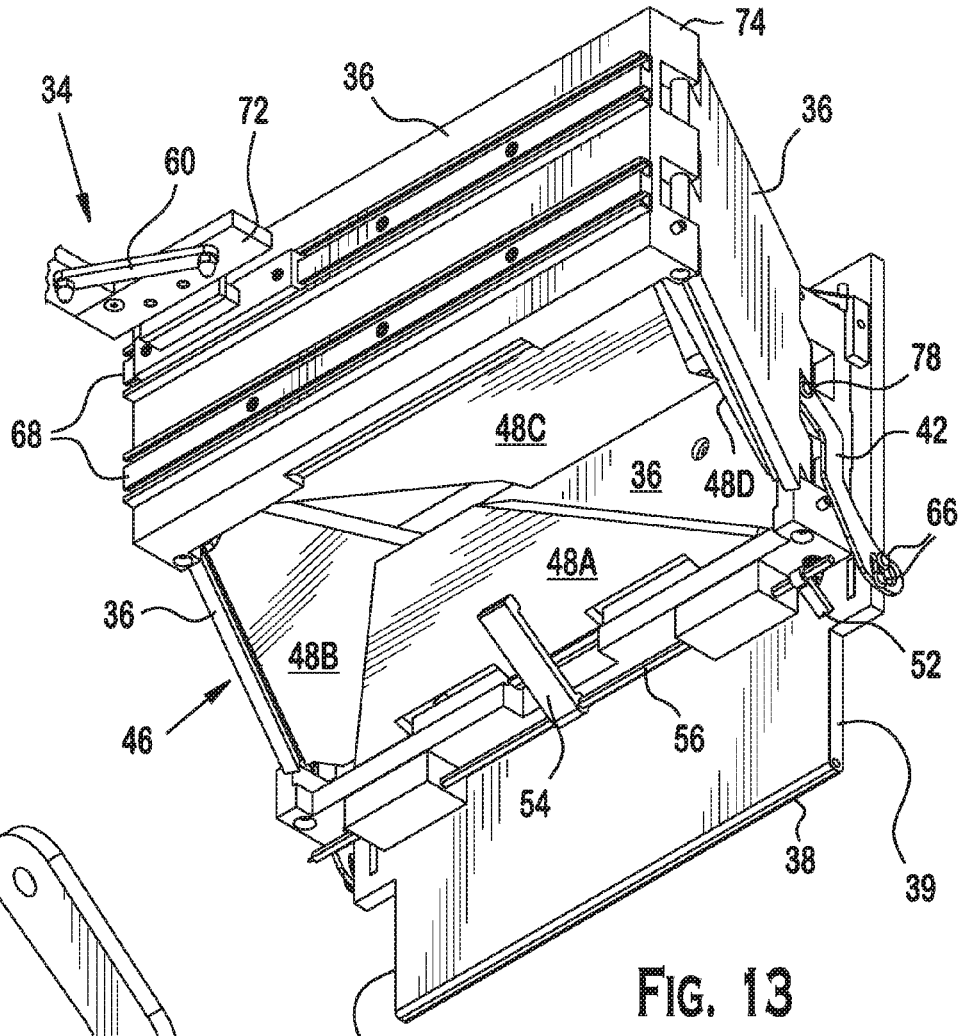
FIG. 13 is a perspective view of the collapsible basket of FIG. 1 illustrating the base moving from the first, lowered base configuration to the second, raised base configuration; The flaps may be driven upward from the rotation of the second rocker arm pedal; The flaps may lift out of the interlocked position and raise inward toward a generally parallel orientation with the sidewall panels; Additionally, the lid is shown in the vertical orientation, parallel to the sidewall; However, the flaps may move between any orientation with respect to the sidewall panels without departing from the scope of the invention.
Figure 14:
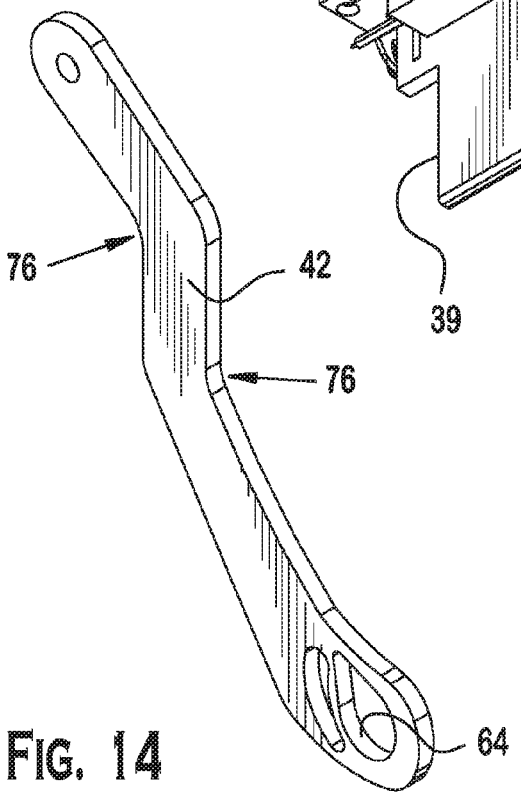
FIG. 14 is a perspective view of another embodiment of the lid mounting hinge of FIG. 3; This embodiment may form an offset, linear connection so as to create clearance for the sidewall panel when the sidewall is being moved from the first, expanded sidewall configuration to the second, collapsed sidewall configuration; The lid mounting hinge may still use two cam journals at one end to facilitate the rotation of the lid.

Referring to FIGS. 13 and 14, a separate embodiment of the present invention can be of a lid mounting hinge 42 separate from that shown in FIGS. 5-7. A separate embodiment of the lid mounting hinge may include an offset lid mounting hinge to preferably provide rotation clearance when the sidewall is moved from the first, expanded sidewall configuration to the second, collapsed sidewall configuration. The alternate embodiment of the lid mounting hinge 42 is defined by alternating, large radius bends 76 positioned so as to offset the circular sidewall connection from the cam journals 64 connections with the lid 38. Referring to FIG. 13, the base may be moveable from a first, lowered base configuration to a second, raised base configuration when the second rocker arm pedal 54 is driven upwards to move the flaps 48A, 48B, 48C, 48D of the base 46 toward the interior of the basket 30.

Figure 15:
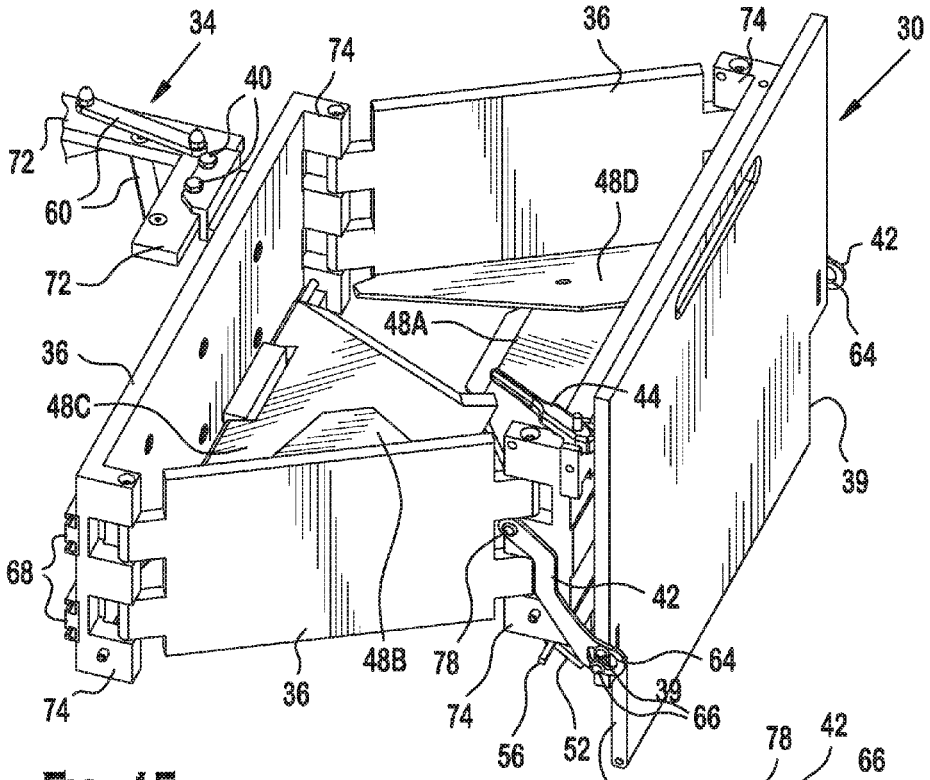
FIG. 15 is a perspective view of the collapsible basket of FIG. 1 illustrating the base moving from the first, lowered base configuration to the second, raised base configuration; Additionally, the sidewall is moving from the first, expanded sidewall configuration to the second, collapsed sidewall configuration; As the lever is rotated, the first linkage is driven downward, rotating the first rocker arm pedal, second linkage, and second rocker arm pedal so as to the drive the flaps of the base upward; As the flaps are moving upward to the second, raised base configuration, the force on the lever continues to collapse the sidewall panels, preferably moving the basket from a generally rectilinear shape to a generally parallelogram shape; Two oppositely facing sidewall panels preferably have perpendicular extensions thereon which can be used to provide bores for a pinned connection to adjacent sidewall panels; the perpendicular extensions preferably cause the associated panels to have a generally U-shape when viewed in a horizontal cross-section.
Figure 16:
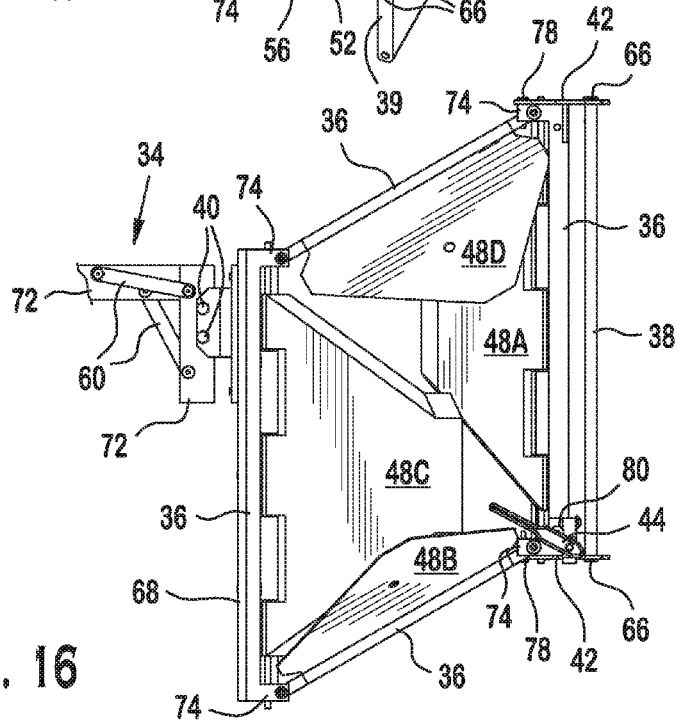
FIG. 16 is a top plan view of the collapsible basket of FIG. 15; The base panels are illustrated as moving upward toward the interior of the basket; The motion of the sidewall panels, driven by the lever, forms the parallelogram shape of the basket as it approaches the second, collapsed sidewall configuration.
Figure 17:
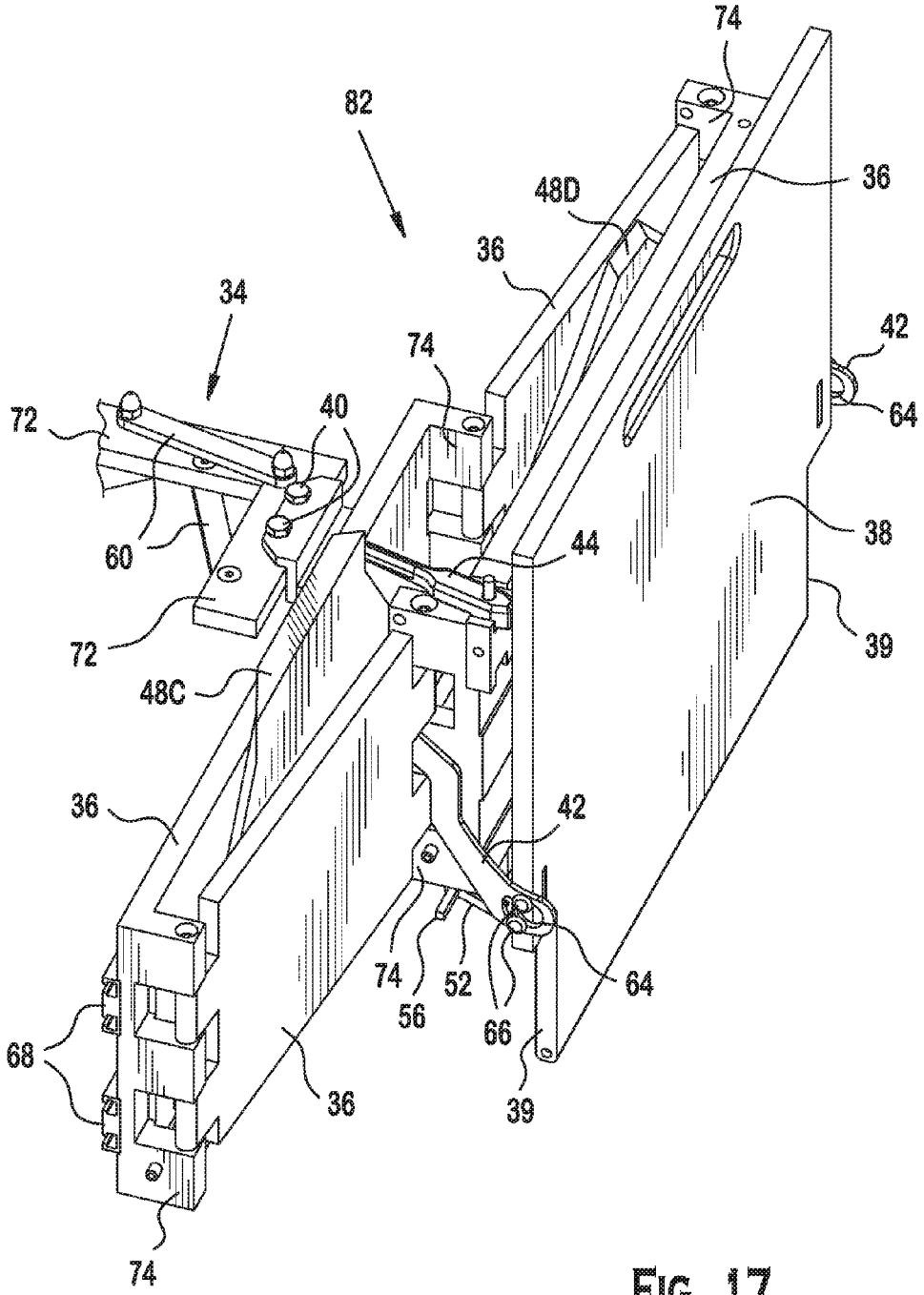
FIG. 17 is a perspective view of the collapsible basket of FIG. 15, illustrating the base in the second, raised base configuration and the sidewall in the second, collapsed sidewall configuration; The mounting arm linkage is shown attached to the sidewall of the collapsible basket; The basket is in the first collapsed basket configuration and may be stowed in any position away from the user; The base flaps are preferably, but not necessarily, fully parallel with the sidewall panels on the interior of the basket, as well as the lid in the vertical orientation; The lid mounting hinge may be formed offset, as illustrated, to avoid interference with the sidewall panel in the second, collapsed sidewall configuration; When the basket is in the second, collapsed sidewall configuration, the sidewall, base, and lid preferably share a common vertical planar orientation, so as to collapse closely adjacent to each other.
Figure 18:
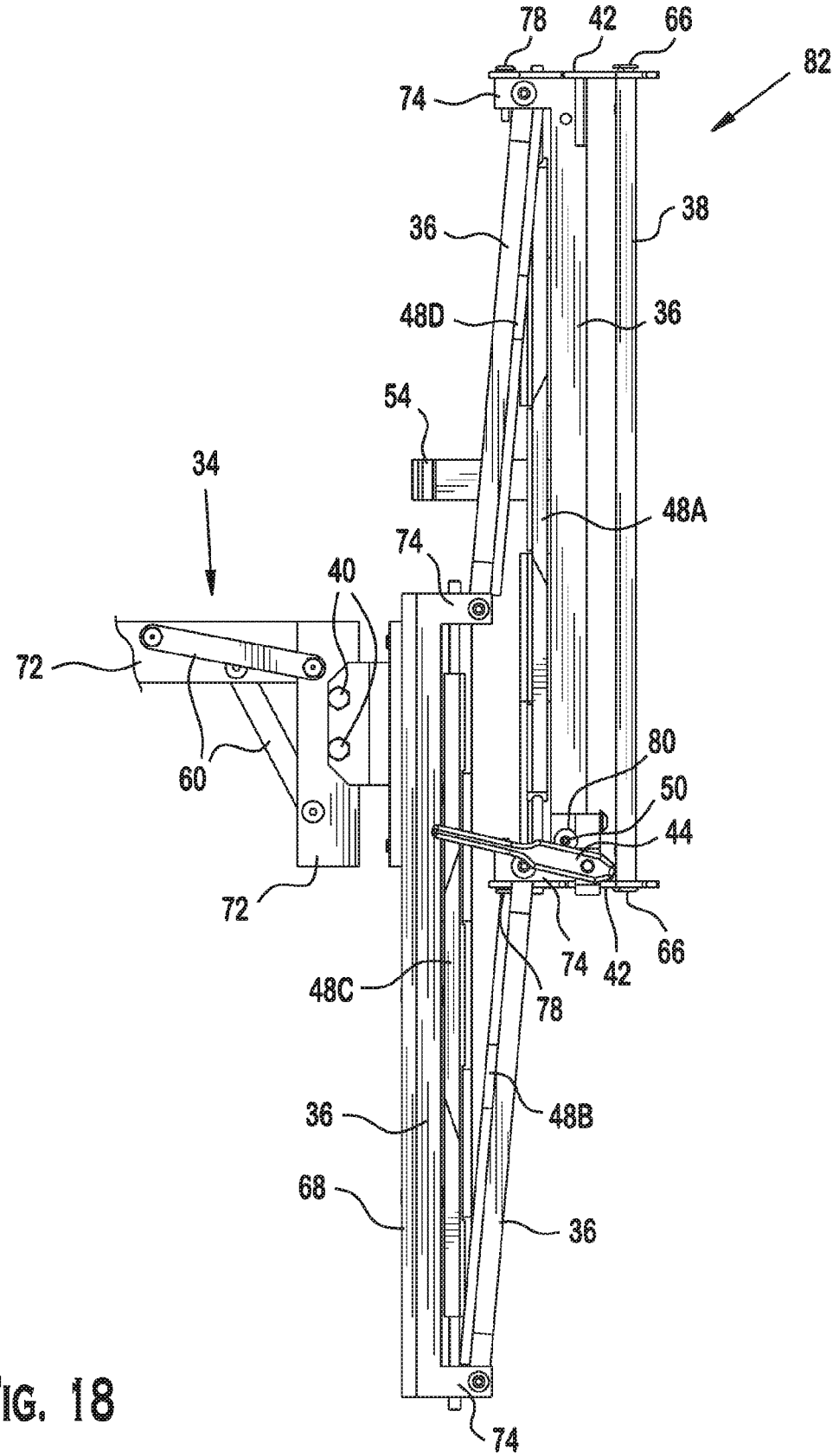
FIG. 18 is a top plan view of the collapsible basket of FIG. 17 illustrating all base flaps and sidewall panels in a generally parallel configuration; Any configuration may be used without departing from the scope of the invention.
Figure 19:
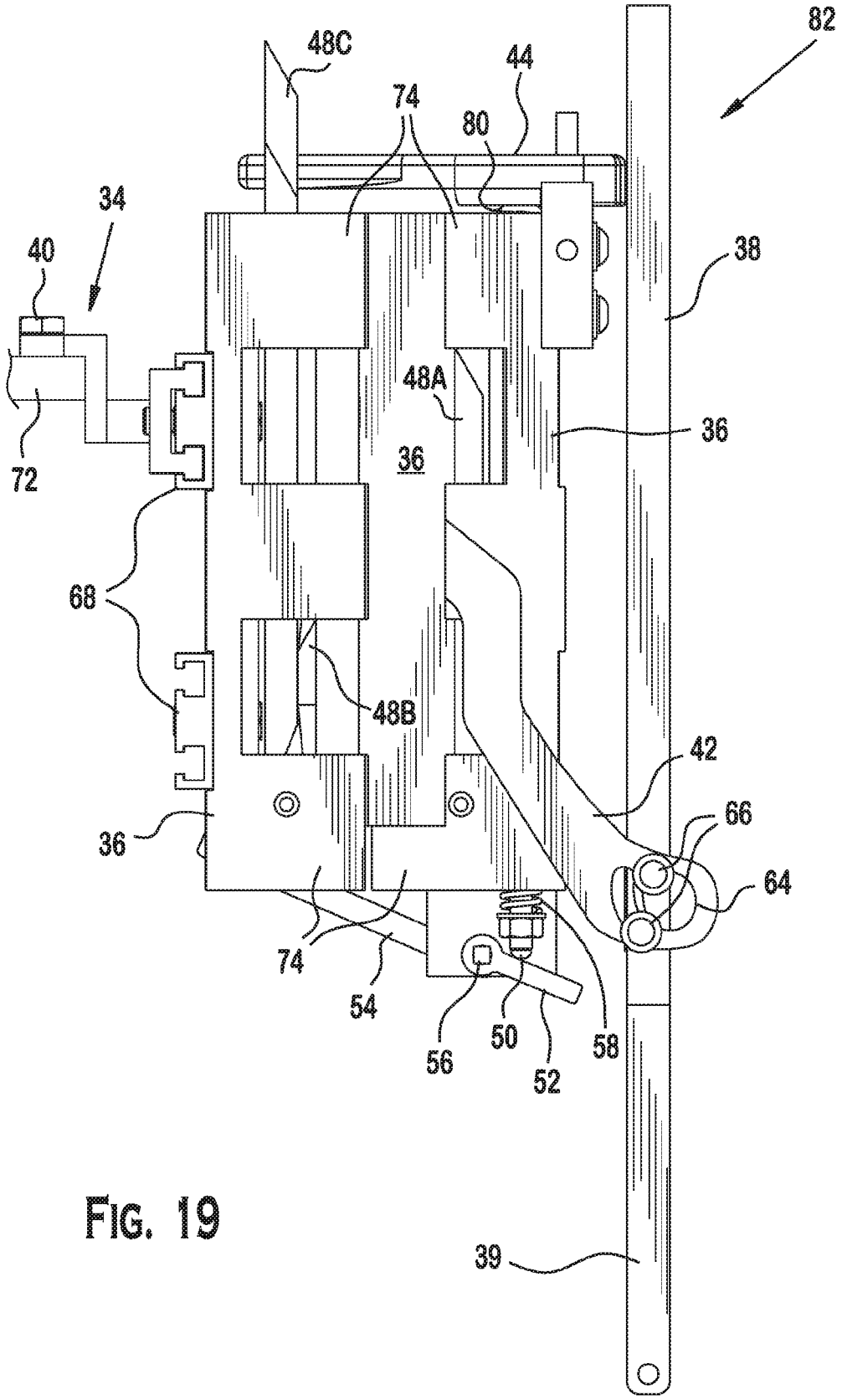
FIG. 19 is a left side view of the collapsible basket of FIG. 17 illustrating the collapsed, generally parallel orientation of the sidewall and base, as well as the offset lid mounting hinge generally clearing the sidewall panel.

Referring to FIGS. 15-18, a preferred embodiment of the present invention can provide the ability of the sidewall to move from a first, expanded sidewall configuration to a second, collapsed sidewall configuration when the base is moved from a first, lowered base configuration to a second, raised base configuration. FIGS. 17 and 18 illustrate the sidewall in the second, collapsed sidewall configuration and the base in the second, raised base configuration. As the sidewall 36 moves toward a parallelogram shape (as seen in FIGS. 15 and 16), the base flaps 48A, 48B, 48C, 48D, raise inwardly within the basket 30 toward a parallel orientation with the sidewall 36. Once the basket 30 is fully in the collapsed position, the sidewall 36, base 46, and lid 38 are generally planar parallel in vertical orientations, reducing the basket 30 to a slim, planar shape for stowage (as seen in FIGS. 17 and 18). Once fully in the second, collapsed sidewall configuration, the sidewall 36, base 46, and lid 38 preferably, but not necessarily, share a similar vertical planar orientation. A preferred embodiment of the basket 30 residing in a primarily vertical orientation may allow the basket 30 to stow in an efficient, space-saving manner. As previously mentioned, any collapsed basket orientation may be used, apart from that shown in the preferred embodiments, to suit the specific structure and location of the basket.

Figure 21:
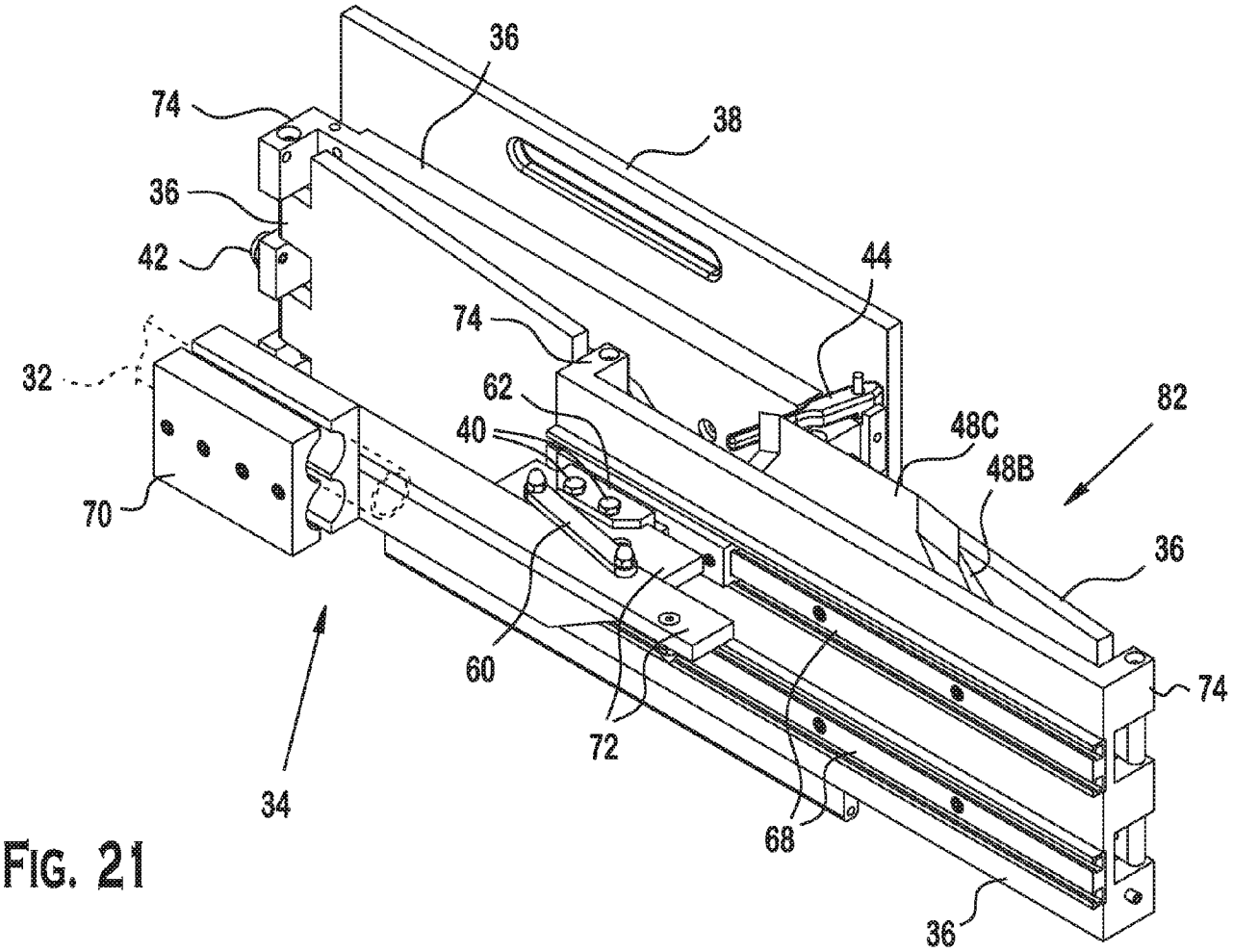
FIG. 21 is a perspective view of the collapsible basket and mounting arm linkage of FIG. 20, illustrating the attachment method of the mounting arm linkage system; The structure mount can provide a lockable clamping force on to the tubes of the wheelchair to rigidly fix the basket to the wheelchair.
Figure 22:
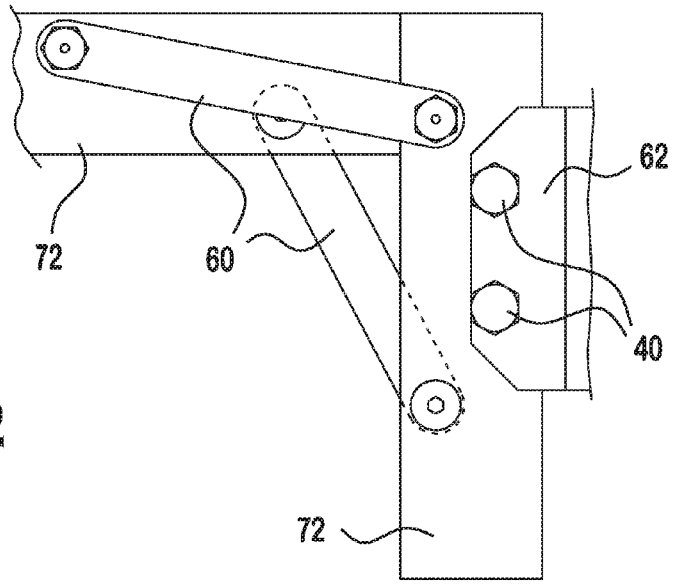
FIG. 22 is a broken away top plan view of the mounting arm linkage system, illustrating the mounting arm linkage system in an extended orientation; In this orientation, the basket may remain in front of the user in an outward position.
Figure 23:
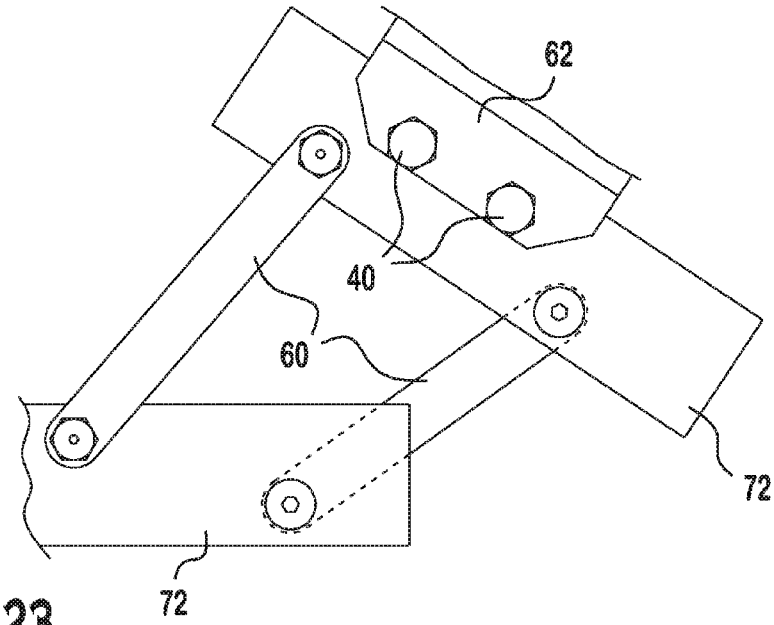
FIG. 23 is a broken away top plan view of the mounting arm linkage system of FIG. 22, illustrating the mounting arm linkage system rotating from the extended orientation to the stowed orientation, whereby the basket is moved away from the user and rotated about the structure.
Figure 24:
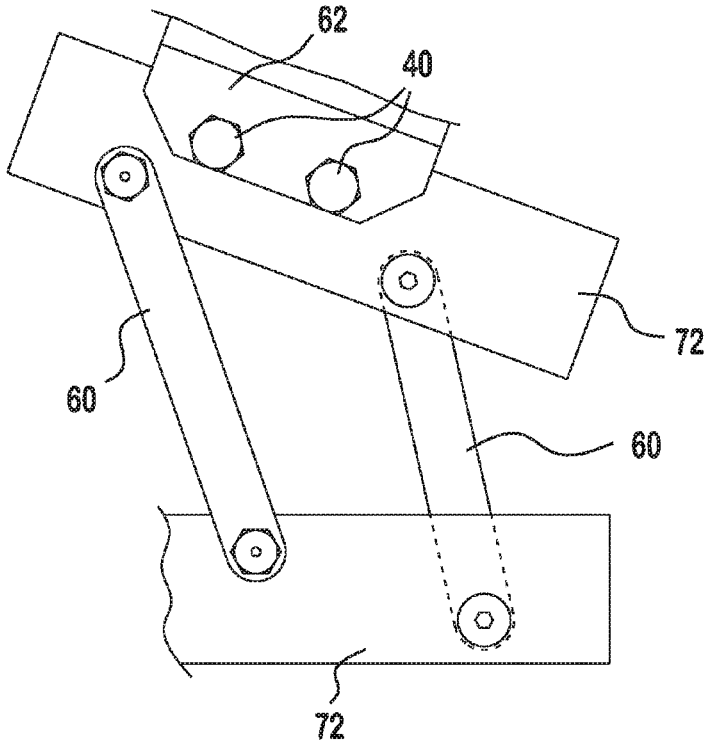
FIG. 24 is broken away top plan view of the mounting arm linkage system of FIG. 22, illustrating the mounting arm linkage system rotating from the extended orientation to the stowed orientation and thereby away from the user and rotating toward the side of the structure.
Figure 25:
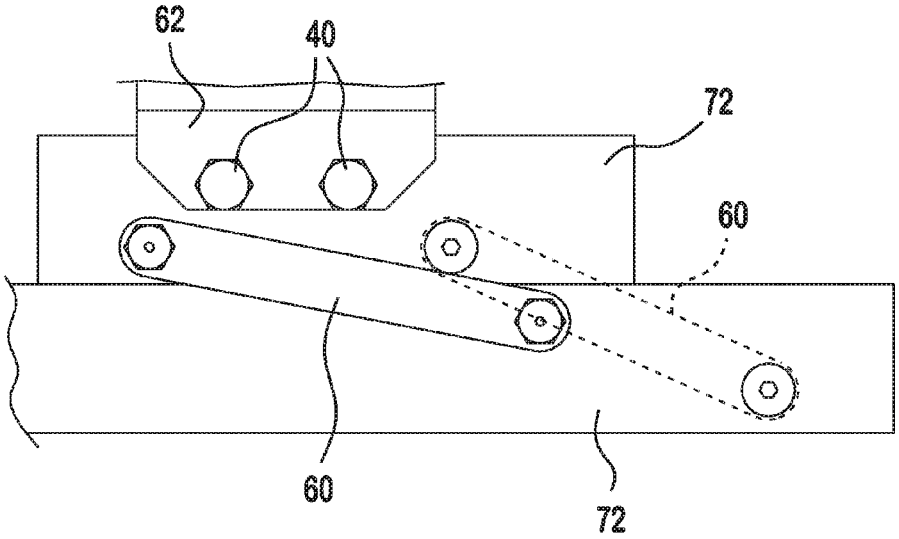
FIG. 25 is broken away top plan view of the mounting arm linkage system of FIG. 22, illustrating the mounting arm linkage system fully positioned in the stowed orientation; The basket may preferably be oriented parallel with the side of the wheelchair or attached structure and away from the user.

Referring to FIGS. 19-25, a preferred embodiment of the present invention provides a mounting linkage system 34 to secure the basket 30 to a structure 32. The mounting linkage system 34 can articulate across a range of rotation and orientation with respect to the basket 30 and the structure 32. The mounting linkage system 34 may further comprise linkage bars 60, structure mount 62, extension beams 72 and bolts 40. The linkage bars 60 and extension beams 72 are preferably generally rectilinear shapes but any means of attachment may be used to articulate motion between the structure mount 62 and the basket 30. The linkage bars 60 preferably rotate the basket 30 about the structure 32. The structure mount 62 and extension bars 72 preferably locate the basket 30 and mounting linkage system 34 to the structure 32. FIGS. 22-25 specifically demonstrate one possible embodiment of the mounting linkage system 34, wherein the linkage bars 60 can provide a full 90 degree rotation of the basket 30, attached via the structure mount 62 and extension beams 74. Any degree of rotation may be used, however. FIGS. 20 and 21 illustrate the basket moving from a position in front of the user to a position to the side of the wheelchair, parallel with the structure mount 62 and side-arm tubing of the wheelchair 32. FIGS. 22-25 specifically illustrate the structure mount 62, extension beams 74, and linkage bars 60 moving from an outward position (FIG. 22) to a stowed position along the side of the wheel chair (FIG. 25). Referring to FIG. 2, while the extension beams 72 are shown mounted proximate the armrest those of ordinary skill in the art will appreciate from this disclosure that the linkage between the wheelchair (or other object) and basket can be connected to the wheelchair at any location thereon without departing from the scope of the present invention.

In one embodiment, the basket is driven through an L-shaped path, as it rotates about the wheelchair 32. The mounting linkage system 34 comprises the adjustment tracks 68, which may allow the basket 30 to move freely in a horizontal plane. The linkage bars 60 may allow the basket 30 to rotate freely about the structure mount 62, and thereby allow the user to dispose the basket 30 anywhere along the generally L-shaped path proximate the side and front of the wheelchair 32.

Figure 26:
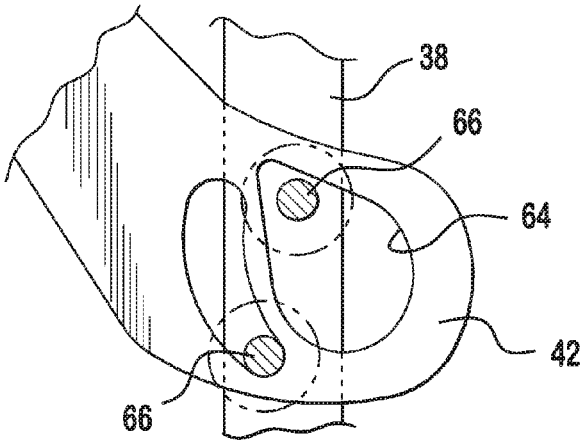
FIG. 26 is a broken away side view of the lid mounting hinge of FIG. 3, illustrating one embodiment of the connecting orifices for attaching the sidewall to the lid; The cam journals may be positioned on the end of the lid mounting hinge, preferably formed in an eye-drop shape to allow efficient rotation of the lid about the basket, but any cam journal shape may be used; Pins may be placed within the cam journals to lock the lid mounting hinge to the lid; The lid mounting hinge is shown in a position when the lid is in the vertical orientation; The basket is preferably prevented from moving into the collapsed position when the lid is in the generally closed position to help reduce the probability of accidental injury.
Figure 27:
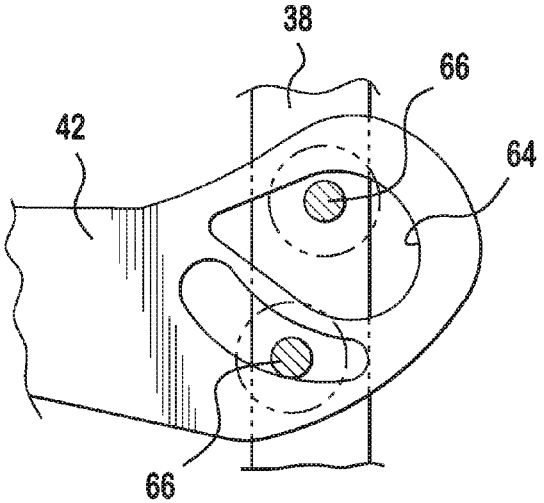
FIG. 27 is a broken away side view of the lid mounting hinge of FIG. 3, illustrating the lid mounting hinge rotating with the lid; The pins may be rotated about the cam journals.
Figure 28:
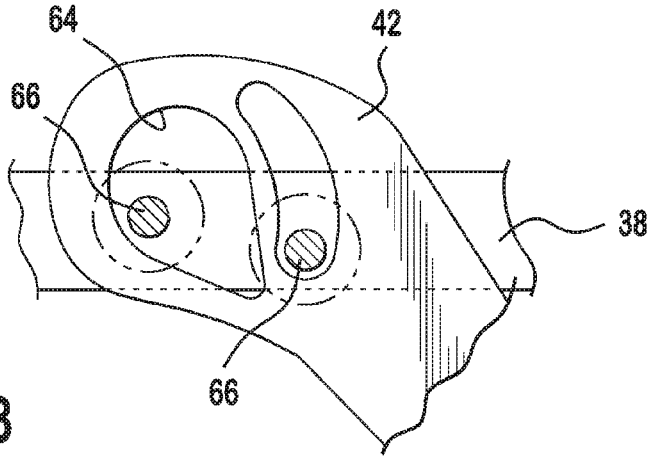
FIG. 28 is a broken away side view of the lid mounting hinge of FIG. 3, illustrating the lid mounting hinge positioned with the lid in the horizontal orientation; The pins may continue to rotate about the cam journal in phase with the rotation of the lid.

Referring to FIGS. 26-28, the lid mounting hinge 42 is preferably provided with cam journals 64 with which the lid mounting hinge 42 can rotate relative to the lid 38. Pins 66 are placed within the cam journals 64 so as to fix the lid 38 to the lid mounting hinge 42, while still allowing free rotation of the lid by allowing the pins 66 to follow the cam journals 64 within the lid mounting hinge 42. The cam journals 66 are each separate shapes. One is preferably tear drop shaped while the other, closely adjacent cam journal is crescent shaped. The cam journals, however, can be of any shape suitable to the device.

A preferred implementation of the preferred method of the present invention will be described below (alone or in combination with various embodiments of the basket 30). The steps of the method of the present invention can be performed in any order, omitted, or combined without departing from the scope of the present invention. As such, optional or required steps described in conjunction with one implementation of the method can also be used with another implementation or omitted altogether. Additionally, unless otherwise stated, similar structure or functions described in conjunction with the below method preferably, but not necessarily, operate in a generally similar manner to that described elsewhere in this application.

The method of the present invention preferably includes the step of providing a sidewall moveable between a first, expanded, sidewall configuration and a second, collapsed sidewall configuration. It is preferred that when in the first expanded, sidewall configuration the sidewall forms at least a first layer of rigid material that forms the lateral sides of the basket 30.

The method of the present invention also preferably includes the step of providing a base moveable between a first, lowered base configuration and a second, raised base configuration. The base preferably secures the sidewall in the first, expanded sidewall configuration when the base is in the first, lowered base configuration. The base also preferably forms at least a second layer of rigid material when the base is in the first, lowered base configuration. The first and second layers of rigid material can be of similar or different composition without departing from the scope of the present invention.

The method of the present invention also preferably includes the step of interconnecting the base to the sidewall such that force applied on the collapsible basket will move the base to the second, raised base configuration and move the sidewall to the second, collapsed sidewall configuration. It is preferred that when the sidewall is in the first, expanded sidewall configuration and the base is in the first, lowered base configuration the first layer of rigid material of the sidewall and the second layer of rigid material of the base combine to provide a rigid shell for lateral sides and the base of the collapsible basket. Those of ordinary skill in the art will appreciate from this disclosure that any suitable method of interconnection can be used without departing from the scope of the present invention.

The method of the present invention also preferably includes the step of biasing the collapsible basket to reduce the amount of force necessary to move the base to the second, raised base configuration and move the sidewall to the second, collapsed sidewall configuration. Biasing can be accomplished by using a resilient member, such as a linear spring, torsion spring, or any other suitable elastic member, using weighting that can be accomplished by varying the size or composition/density of mechanical components or any other suitable biasing method without departing from the scope of the present invention.

The method of the present invention also preferably, but not necessarily, includes the interconnecting being accomplished without using any motorized components nor any electrical components for moving the basket between a first collapsed basket configuration and a second expanded basket configuration. It is preferred that when the basket is in the first, collapsed basket configuration the plurality of panels and the base are all generally planar parallel, the vertical orientation of the plurality of panels of the sidewall being the same when the basket is in the first, expanded basket configuration and when the basket is in the second, collapsed basket configuration. However, those of ordinary skill in the art will appreciate from this disclosure that electrical components or motors can be used without departing from the scope of the present invention. For example, a solenoid can be used in place of the lever or another automated motor can be used to allow pushbutton operation.

Referring to FIGS. 1-4, one preferred embodiment of the present invention operates as follows. A user, preferably seated in a wheelchair 32 with the basket 30 in the second expanded basket configuration may provide a horizontal force on the lever 44, thereby driving the linkage mechanism, comprising a first linkage 50, downward, rotating the first rocker arm pedal 52, second linkage 56, and second rocker arm pedal 54 to provide a vertical force upward on the flaps 48A, 48B, 48C, 48D of the base 46. Preferably, the base will then begin to move from the first, lowered base configuration to the second, raised base configuration as the sidewall moves from the first expanded sidewall configuration to the second collapsed sidewall configuration. Preferably, as the user provides a horizontal force on the lever 44, the basket advances toward the second collapsed basket configuration, whereby the sidewall 36 and base 46 approach a shared vertical planar orientation. Once fully in the second collapsed basket configuration, the user may continue to drive the collapsed basket 30 about the wheelchair 32 for stowage along the side of the wheelchair 32, where further adjustment of the basket 30 along the adjustment tracks 68 may be provided.

It is recognized by those skilled in the art that changes may be made to the above described methods, basket 30 or structure 32, without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A combination wheelchair and basket, comprising:

a wheelchair configured for supporting a user seated thereon;

a basket affixed to the wheelchair such that, without detaching the basket therefrom, the basket can be moved between a storage position, in which motion of the user into or out of the wheelchair is not impeded by the basket, and a use position, in which the basket is positioned over a lap of the user while the user is seated on the wheelchair;

the basket further comprising:

a sidewall moveable between a first, expanded, sidewall configuration and a second, collapsed sidewall configuration;

a base moveable between a first, lowered base configuration and a second, raised base configuration, the base securing the sidewall in the first, expanded sidewall configuration when the base is in the first, lowered base configuration;

the basket being moveable between a first collapsed basket configuration and a second expanded basket configuration, when the basket is in the second expanded configuration the sidewall is in the first expanded sidewall configuration and the base is in the first, lowered base configuration; and wherein the basket can be moved between the first collapsed basket configuration and the second expanded basket configuration while the basket is in the use position, the sidewall and the base being formed of rigid material.

2. The combination of claim 1, wherein the basket further comprises:

a lever disposed on the sidewall;

a linkage mechanism located on the basket and configured such that rotation of the lever drives the base from the first, lowered base configuration to the second, raised base configuration when the sidewall is in the first, expanded, sidewall configuration;

a resilient member disposed on the basket to reduce a force required to rotate the lever and move the base from the first lowered, base configuration into the second, raised base configuration; and wherein the linkage mechanism further comprises a first linkage proximate to the lever and located at least one of in, through, and adjacent to the sidewall, rotation of the lever engaging the first linkage and driving the first linkage between a raised first linkage position and a lowered first linkage position.

3. The combination of claim 2, wherein the linkage mechanism further comprises a second linkage extending under at least one of the base and the sidewall and engaged with the first linkage, the second linkage being moveable between one second linkage position and another second linkage position.

4. The combination of claim 3, wherein the linkage mechanism further comprises the first linkage engaging the second linkage via a first rocking arm pedal such that movement of the first linkage into the lowered first linkage position drives the first rocking arm pedal and drives the second linkage into the another second linkage position.

5. The combination of claim 4, wherein the linkage mechanism further comprises a second rocking arm pedal attached to the second linkage, wherein the second rocking arm pedal is configured to engage the base and move the base from the first, lowered base configuration and into the second, raised base configuration when the second linkage is in the another second linkage position.

6. The combination of claim 1, wherein the sidewall further comprises a plurality of panels, attached end-to-end to form a rectilinear shape.

7. The combination of claim 6, wherein the base further comprises a plurality of flaps, each flap attached independently to a separate one of the plurality of panels.

8. The combination of claim 2, wherein the resilient member is located axially in-line with the first linkage.

9. The combination of claim 6, wherein a pair of opposing-face panels of the plurality of panels each include a plurality of perpendicular extensions thereon.

10. The combination of claim 1, wherein the basket does not have any motorized components nor any electrical components for moving the basket between the first collapsed basket configuration and the second expanded basket configuration such that movement therebetween is accomplished by at least one of a linkage mechanism and a resilient member.

11. The combination of claim 6, wherein a lid is attached to one of the plurality of panels, the lid rotatable between a vertical orientation, such that the lid is parallel with the plurality of panels, and a horizontal orientation, such that the lid is perpendicular with the plurality of panels.

12. A combination wheelchair and basket, comprising:

a wheelchair configured for supporting a user seated thereon;

a basket affixed to the wheelchair such that, without detaching the basket therefrom, the basket can be moved between a storage position, in which motion of the user into or out of the wheelchair is not impeded by the basket, and a use position, in which the basket is positioned over a lap of the user while the user is seated on the wheelchair;

the basket further comprising:

a sidewall moveable between a first, expanded, sidewall configuration and a second, collapsed sidewall configuration, wherein the sidewall comprises a plurality of panels, attached end-to-end to form a rectilinear shape when in the first, expanded, sidewall configuration;

a base moveable between a first, lowered base configuration and a second, raised base configuration, the base securing the sidewall in the first, expanded sidewall configuration when the base is in the first, lowered base configuration;

the basket being moveable between a first collapsed basket configuration and a second expanded basket configuration, when the basket is in the second expanded configuration the sidewall is in the first expanded sidewall configuration and the base is in the first, lowered base configuration.

13. The combination of claim 12, wherein the basket further comprises:

a lever disposed on the sidewall;

a linkage mechanism located on the basket and configured such that rotation of the lever drives the base from the first, lowered base configuration to the second, raised base configuration when the sidewall is in the first, expanded, sidewall configuration;

a resilient member disposed on the basket to reduce a force required to rotate the lever and move the base from the first lowered, base configuration into the second, raised base configuration; and wherein the linkage mechanism further comprises a first linkage proximate to the lever and located at least one of in, through, and adjacent to the sidewall, rotation of the lever engaging the first linkage and driving the first linkage between a raised first linkage position and a lowered first linkage position.

14. The combination of claim 13, wherein the linkage mechanism further comprises a second linkage extending under at least one of the base and the sidewall and engaged with the first linkage, the second linkage being moveable between one second linkage position and another second linkage position.

15. The combination of claim 14, wherein the linkage mechanism further comprises the first linkage engaging the second linkage via a first rocking arm pedal such that movement of the first linkage into the lowered first linkage position drives the first rocking arm pedal and drives the second linkage into the another second linkage position.

16. The combination of claim 15, wherein the linkage mechanism further comprises a second rocking arm pedal attached to the second linkage, wherein the second rocking arm pedal is configured to engage the base and move the base from the first, lowered base configuration and into the second, raised base configuration when the second linkage is in the another second linkage position.

17. The combination of claim 12, wherein the base further comprises a plurality of flaps, each flap attached independently to a separate one of the plurality of panels.

18. The combination of claim 12, wherein a pair of opposing-face panels of the plurality of panels each include a plurality of perpendicular extensions thereon.

19. The combination of claim 12, wherein the basket does not have any motorized components nor any electrical components for moving the basket between the first collapsed basket configuration and the second expanded basket configuration such that movement therebetween is accomplished by at least one of a linkage mechanism and a resilient member.

20. The combination of claim 12, wherein a lid is attached to one of the plurality of panels, the lid rotatable between a vertical orientation, such that the lid is parallel with the plurality of panels, and a horizontal orientation, such that the lid is perpendicular with the plurality of panels.

* * * * *